US009662669B2

(12) United States Patent
Yamada

(10) Patent No.: US 9,662,669 B2
(45) Date of Patent: May 30, 2017

(54) ELECTROSTATIC COATING APPARATUS

(71) Applicant: ABB K.K., Shibuya-ku (JP)

(72) Inventor: Yukio Yamada, Fujieda (JP)

(73) Assignee: ABB K.K., Shinagawa-ku (JP)

( * ) Notice: Subject to any disclaimer, the term of this patent is extended or adjusted under 35 U.S.C. 154(b) by 305 days.

(21) Appl. No.: 14/235,941

(22) PCT Filed: Jan. 17, 2013

(86) PCT No.: PCT/JP2013/050785
§ 371 (c)(1),
(2) Date: Jan. 29, 2014

(87) PCT Pub. No.: WO2013/111664
PCT Pub. Date: Aug. 1, 2013

(65) Prior Publication Data
US 2014/0245951 A1 Sep. 4, 2014

(30) Foreign Application Priority Data
Jan. 25, 2012 (JP) ..... 2012-012941

(51) Int. Cl.
*B05B 5/053* (2006.01)
*B05B 5/10* (2006.01)
*B05B 5/04* (2006.01)

(52) U.S. Cl.
CPC ..... *B05B 5/053* (2013.01); *B05B 5/0415* (2013.01); *B05B 5/0531* (2013.01); *B05B 5/10* (2013.01); *B05B 5/0407* (2013.01); *B05B 5/0426* (2013.01)

(58) Field of Classification Search
None
See application file for complete search history.

(56) References Cited

U.S. PATENT DOCUMENTS

2005/0040262 A1 2/2005 Nagai
2007/0227445 A1* 10/2007 Yamada ..... B05B 3/1035 118/621

FOREIGN PATENT DOCUMENTS

JP 58061852 A * 4/1983
JP 63-8816 2/1988
WO 2005/009621 A1 2/2005
WO 2006/016472 A1 2/2006

OTHER PUBLICATIONS

International Search Report issued Mar. 12, 2013, in PCT/JP2013/050785, filed Jan. 17, 2013.

* cited by examiner

*Primary Examiner* — Dah-Wei D Yuan
*Assistant Examiner* — Stephen Kitt
(74) *Attorney, Agent, or Firm* — Oblon, McClelland, Maier & Neustadt, L.L.P.

(57) ABSTRACT

A current detection resistor is connected between an output terminal of a high voltage generator and an air motor. A coater current detector detects a coater current supplied to a coater based on a potential difference taking place on both terminals of the current detection resistor. The high-voltage control device serves to discriminate based on the coater current detected by the coater current detector whether the coater is caused to be close to a coating object. When it is discriminated that the coater is caused to be close to the coating object, the high-voltage control device outputs a shut-off signal for shutting off supply of the power supply voltage to the power supply voltage control device.

7 Claims, 11 Drawing Sheets

ELECTROSTATIC COATING APPARATUS

TECHNICAL FIELD

The present invention relates to an electrostatic coating apparatus adapted for spraying paint with a high voltage being applied thereto.

BACKGROUND ART

In general, there is known, as an electrostatic coating apparatus, an electrostatic coating apparatus configured to comprise a coater operative to spray paint toward coating objects by using a rotary atomizing head, a high voltage generator operative to boost a power voltage to generate a high voltage to output the high voltage toward the rotary atomizing head of the coater, a power supply voltage control device operative to control a power supply voltage supplied to the high voltage generator, and a high-voltage control device operative to output, to the power supply voltage control device, a setting signal for setting a power supply voltage to control a high voltage outputted from the high voltage generator (Patent Document 1).

Since, for example, the rotary atomizing head constitutes an electrode for discharging a high voltage in such an electrostatic coating apparatus according to the conventional art, an electrostatic field is formed between the rotary atomizing head and a coating object caused to have an earth potential. Paint particles electrified so as to have a high voltage through the rotary atomizing head fly toward coating objects along electric lines of force of this electrostatic field so that they are deposited thereonto.

PRIOR ART DOCUMENT

Patent Document

Patent Document 1: International Publication No. WO 2006/016472 A1

SUMMARY OF THE INVENTION

Meanwhile, the electrostatic coating apparatus described in the Patent document 1 was operative to detect a current (full return current) flowing in a high-voltage application path including the high voltage generator, and to detect a leakage current produced at a surface of a cover of the coater, and each paint passage or each air passage within the coater. Thus, a leakage current is subtracted from the full return current to thereby compute a coating object current flowing between the coater and the coating object to monitor whether the coating object current is excessive.

In this case, output terminals of the high voltage generator are adapted so that one terminal is grounded and the remaining other terminal is used as a voltage generating terminal. Since a voltage becomes equal to several ten kV or more, for example, it is difficult from an insulating point of view to directly detect a current in general. For this reason, the full return current is detected on the grounded output terminal side.

However, also in a multi-stage voltage doubler rectifier circuit constituting the high voltage generator, any leakage current may take place. Moreover, voltage sensors are connected to the output side of the high voltage generator so that leakage currents through the voltage sensors may also take place. Such leakage currents are very weak currents of about several ten μA. On the other hand, coating object current is also the order of an approximately several ten μA to several hundred μA, and current increment for determining insulation extraordinary state is a weak current of about several ten μA. For this reason, when leakage current in the high voltage generator, and the like are disregarded, there is a tendency such that it is impossible to precisely grasp the magnitude of coating object current.

Moreover, when the coater and the coating object are caused to be close to each other, coating object current is increased. In view of the above, it is possible to monitor, based on the magnitude of coating object current, whether the coater and the coating object are caused to be excessively close to each other. On the other hand, in recent years, electrostatic coating at a narrow place is being increased like indoor coating of an automotive vehicle, for example. In this case, it is impossible to sufficiently maintain the distance between the coater and the coating object with a margin. For this reason, there is a necessity to perform coating within the range where the distance between the coater and the coating object is small, and there is such a demand to precisely grasp increase in the coating object current.

On the contrary, in the electrostatic coating apparatus described in the Patent document 1, it is impossible to grasp precise coating object current. For this reason, even when the distance between the coater and the coating object is shortened within the range where no spark actually takes place, there is a tendency such that supply of high voltage is erroneously stopped. As a result, there is the problem that the movable range of the coater would be narrowed so that the workability of coating is lowered.

In view of the above-described problems of the conventional art, it is an object of the present invention to provide an electrostatic coating apparatus capable of suitably detecting an increase in coating object current.

(1) The present invention is applied to an electrostatic coating apparatus, comprising: a coater adapted for spraying paint onto a coating object; a high voltage generator which boosts a power supply voltage to generate a high voltage and outputs the high voltage to the coater; a power supply voltage control device which supplies the power supply voltage to the high voltage generator; and a high-voltage control device which outputs a setting signal for setting the power supply voltage to the power supply voltage control device and controls the high voltage outputted from the high voltage generator.

In order to solve the above-described problems, the feature of the configuration adopted by the present invention is that a current detection resistor is connected between the high voltage generator and the coater, a coater current detector which detects a coater current supplied to the coater based on a potential difference produced on both terminals of the current detection resistor is provided, and the high-voltage control device is configured to output a shut-off signal for shutting off supply of the power supply voltage to the power supply voltage control device when it is discriminated by using the coater current detected by the coater current detector that the coater is caused to be close to the coating object.

According to the present invention, the coater current supplied to the coater does not include leakage current produced within the high voltage generator. For this reason, as compared to the full return current including such leakage current, coating object current is easy to be reflected. Accordingly, since it is possible to suitably detect an increase in the coating object current based on the coater current, the high-voltage control device can discriminate whether the coater is caused to be excessively close to the coating object by using the coater current detected by the coater current detector. Thus, even if the distance between the coater and the coating object is reduced, it is possible to continue supply of high voltage within the range where spark takes place as a range where normal coating can be performed, for example. As a result, even in the case where coating is performed at a narrow place, it is possible to broaden the movable range of the coater, thus making it possible to enhance the workability of coating.

(2) In the present invention, the coater current detector comprises: an input side voltage-dividing circuit which divides a voltage applied to an input terminal of the current detection resistor; an output side voltage-dividing circuit which divides a voltage applied to an output terminal of the current detection resistor; and a coater current computing processor which subtracts a current flowing in the output side voltage-dividing circuit from a current flowing in the current detection resistor based on an input side voltage detection value detected by the input side voltage-dividing circuit and an output side voltage detection value detected by the output side voltage-dividing circuit to compute the coater current.

According to the present invention, it is possible to detect a voltage applied to both terminals of the current detection resistor by the input side voltage-dividing circuit and the output side voltage-dividing circuit. At this time, an input side voltage detection value detected by the input side voltage-dividing circuit and an output side voltage detection value detected by the output side voltage-dividing circuit result in values corresponding to voltages applied to the both terminals of the current detection resistor. For this reason, a potential difference taking place on both terminals of the current detection resistor by the input side voltage detection value and the output side voltage detection value is computed to have ability to compute a current flowing in the current detection resistor. Moreover, since a current flowing in the output side voltage-dividing circuit results in a value corresponding to the output side voltage detection value, it is possible to compute a current flowing in the output side voltage-dividing circuit based on the output side voltage detection value. For this reason, the coater current computing processor serves to subtract a current flowing in the output side voltage-dividing circuit from a current flowing in the current detection resistor, thereby making it possible to compute a coater current.

(3) In the present invention, there is provided such a configuration to comprise a full return current detector which detects a full return current flowing in the high-voltage application path including the high voltage generator, wherein the high-voltage control device is configured to comprise a full return current extraordinary state processor which outputs a shut-off signal for shutting off supply of the power supply voltage to the power supply voltage control device when an absolute value of a full return current detected by the full return current detector exceeds a predetermined shut-off threshold current value, or when a variation amount of the full return current exceeds a predetermined shut-off variation amount.

According to the present invention, the high-voltage control device serves to discriminate whether an absolute value of the full return current detected by the full return current detector exceeds the predetermined shut-off threshold current value, or whether a variation amount of the full return current exceeds the predetermined shut-off threshold variation amount, thereby making it possible to discriminate whether the insulating property of the coater is deteriorated. In addition thereto, since the full return current includes leakage current produced in the high voltage generator, it is possible to discriminate, based on the full return current, a leakage current in the high voltage generator is increased. Thus, the high-voltage control device can discriminate that the coater is caused to be extraordinarily close to the coating object by using the full return current so that the insulating property of the coater is deteriorated, and can discriminate, in addition thereto, degradation in insulation of the high voltage generator.

(4) In the present invention, the high-voltage control device is configured to comprise a coater current extraordinary state processor which outputs a shut-off signal for shutting off supply of the power supply voltage to the power supply voltage control device when an absolute value of a coater current detected by the coater current detector exceeds a predetermined shut-off threshold current value, or when a variation amount of the coater current exceeds a predetermined shut-off threshold variation amount.

According to the present invention, the high-voltage control device serves to discriminate whether an absolute value of the coater current detected by the coater current detector exceeds the predetermined shut-off threshold current value, or whether a variation amount of the coater current exceeds a predetermined shut-off threshold variation amount, thereby making it possible to discriminate whether the coater is caused to be extraordinarily close to the coating object. Thus, the high-voltage control device can shut off supply of the power supply voltage when the coater is caused to be extraordinarily close to the coating object. On the other hand, as the conventional art, in the case of discriminating by using the absolute value of the full return current or the variation amount of the full return current whether the coater is caused to be extraordinarily close to the coating object, variation of the coating object current is relaxed based on a leakage current taking place in the high voltage generator, and the like so that precision is apt to be lowered. On the contrary, in the present invention, since whether the coater is caused to be extraordinarily close to the coating object is discriminated by using the absolute value of the coater current or the variation amount of the coater current, it is possible to grasp the access state of the coating object with high precision.

(5) In the present invention, there is further provided a configuration further comprising a leakage current detector which detects a leakage current flowing without passing through the coating object, wherein the high-voltage control device comprises: a coating object current computing processor which subtracts a leakage current detected by the leakage current detector from the coater current detected by the coater current detector to compute a coating object current flowing between the coater and the coating object, and a coating object current extraordinary state processor which outputs a shut-off signal for shutting off supply of the power supply voltage to the power supply voltage control device when an absolute value of the coating object current by the coating object current computing processor exceeds a predetermined shut-off threshold current value.

According to the present invention, the coating object current extraordinary state processor serves to discriminate whether an absolute value of the coating object current exceeds a predetermined shut-off threshold current value to thereby have ability to discriminate whether the coater is caused to be close to the coating object. As a result, the high-voltage control device is operative so that even when a leakage current which is not passed through the coating object is increased, it can precisely grasp the coating object current flowing between the coater and the coating object, and can more precisely discriminate by using the coating object current that the coater is caused to be extraordinarily close to the coating object so that the insulating property of the coater is deteriorated.

(6) In the present invention, the high-voltage control device is configured to further comprise an insulation deterioration alarm processor which serves to notify that insulation deterioration takes place in the coater when it is discriminated by using the leakage current detected by the leakage current detector that insulation deterioration at an initial stage takes place.

According to the present invention, the high-voltage control device serves to discriminate whether an absolute value of a leakage current detected by, for example, the leakage current detector exceeds a predetermined alarm threshold current value which is smaller than the predetermined shut-off threshold current value to thereby have ability to discriminate whether the insulating property of the coater is deteriorated to a degree such that the dielectric breakdown can take place. Thus, the high-voltage control device can grasp development state of the dielectric breakdown at portions except for parts between the coating object and the coater (for example, the surface of the cover of the coater, the internal surface of the paint passage, the internal surface of the air passage, and the like) by using the leakage current. For this reason, before damage due to each creeping discharge at these respective portions is developed, insulation deterioration is notified by, for example, occurrence of alarm, and the like thus to have ability to hasten a worker to perform maintenance (inspection, cleaning, and the like) of the coater. Consequently, it is possible to prevent damage of the coater to enhance reliability and durability.

MODE FOR CARRYING OUT THE INVENTION

Figure 1:
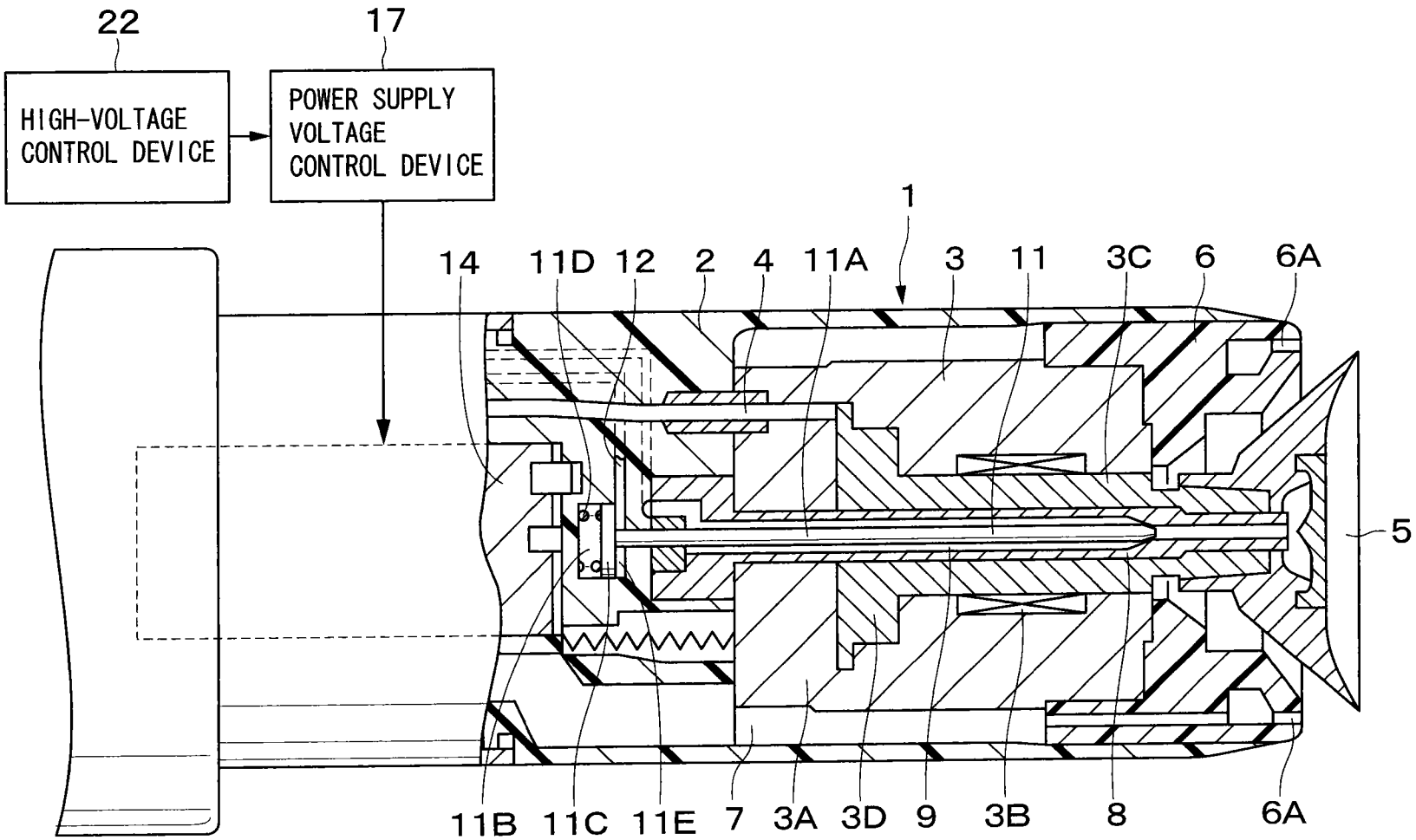
FIG. 1 is a partially broken front view showing a rotary atomizing head type coating apparatus according to a first embodiment.

Hereinafter, explanation will now be given in detail with reference to the attached drawings by taking, as an example, a rotary atomizing head type coating apparatus as an electrostatic coating apparatus according to the embodiments of the present invention.

FIGS. 1 to 4 illustrate a rotary atomizing head type coating apparatus according to the first embodiment. In the drawings, a coater 1 is configured to include a cover 2, an air motor 3, and a rotary atomizing head 5, which will be described later. This coater 1 serves to spray paint toward a coating object A having earth potential.

The cover 2 is formed cylindrical by using an insulating resin material. This cover 2 is adapted to cover the air motor 3, and the high voltage generator 14, and the like.

The air motor 3 is accommodated in the inner circumferential side of the cover 2, and is formed by a conductive metallic material. This air motor 3 comprises a motor housing 3A, a hollow rotational shaft 3C rotatably supported through a static air bearing 3B within the motor housing 3A, and an air turbine 3D fixed to the base end side of the rotational shaft 3C. A driving air passage 4 provided within the coater 1 is connected to the air motor 3. The air motor 3 serves to be supplied with a drive air through the driving air passage 4 to the air turbine 3D to rotate the rotational shaft 3C and the rotary atomizing head 5 at a high speed of, 3000 to 150000 rpm, for example.

The rotary atomizing head 5 is attached to the front end side of the rotational shaft 3C of the air motor 3. This rotary atomizing head 5 is formed by a metallic material or conductive resin material, for example. By supplying paint to the rotary atomizing head 5 through a feed tube 8 which will be described later in a state of being rotated at a high speed by the air motor 3, the rotary atomizing head 5 sprays such paint from the peripheral edge thereof by centrifugal force. On the other hand, high voltage generator 14 which will be described later is connected to the rotary atomizing head 5 through the air motor 3, and the like. Thus, in the case where the electrostatic coating is implemented, it is possible to apply a high voltage to the entirety of the rotary atomizing head 5. Thus, it is possible to directly electrify paint flowing on these surfaces so as to have a high voltage.

A shaping air ring 6 is provided on the front end side of the cover 2 in such a manner to surround the outer circumferential side of the rotary atomizing head 5. This shaping air ring 6 is provided with a plurality of air spouting holes 6A bored, and the air spouting holes 6A are adapted so that a shaping air passage 7 provided within the coater 1 communicates therewith. Shaping air is supplied to the air spouting holes 6A through the shaping air passage 7, and shaping air is sprayed toward paint sprayed from the rotary atomizing head 5 through air spurting holes 6A. Thus, such shaping air forms a spraying pattern of painting particles sprayed from the rotary atomizing head 5.

Figure 2:
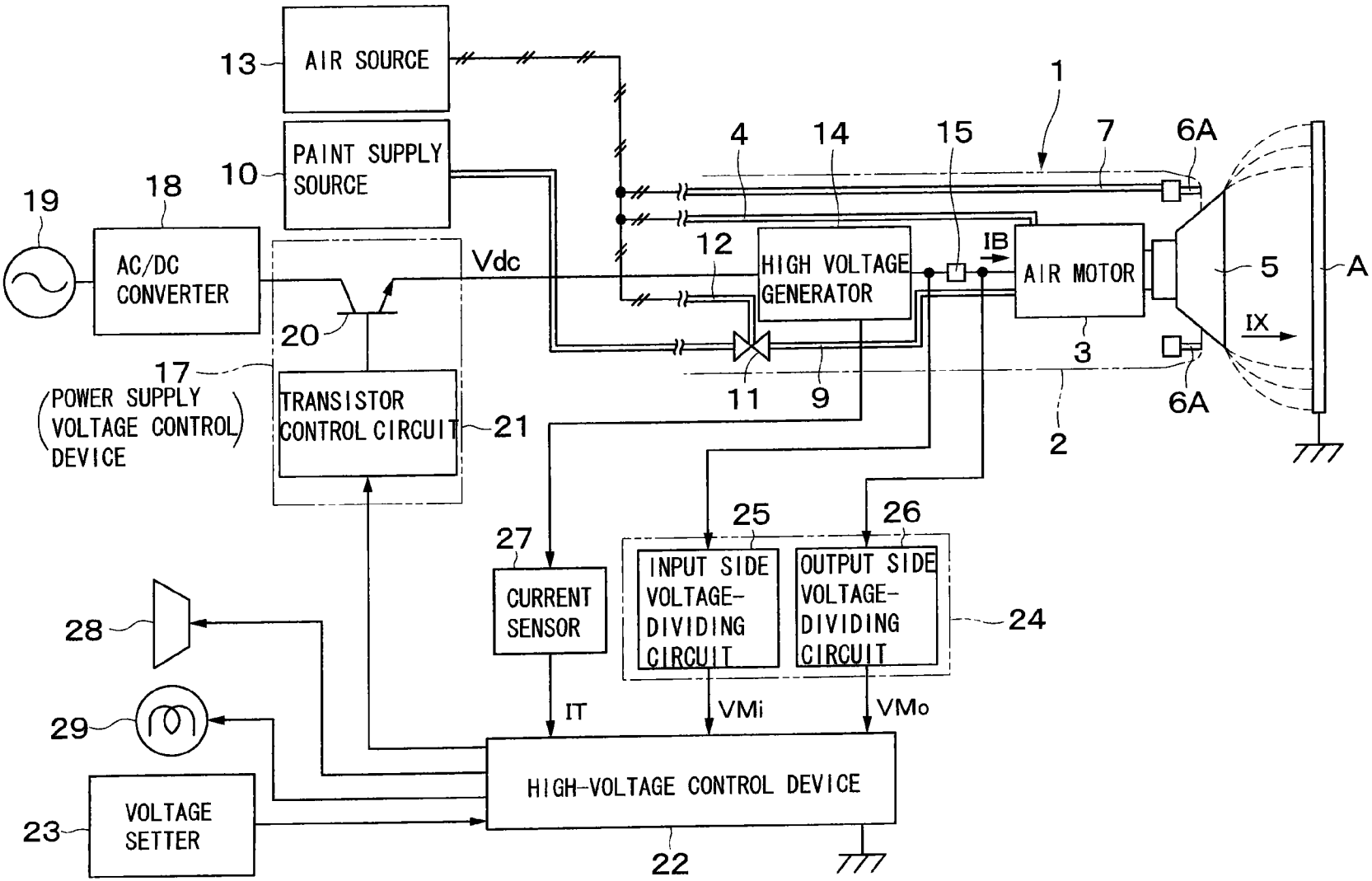
FIG. 2 is a diagram showing the entire configuration of the rotary atomizing head type coating apparatus according to the first embodiment.

A feed tube 8 is provided by being inserted through the rotational shaft 3C. The front end side of the feed tube 8 is projected from the front end of the rotational shaft 3C to extend into the rotary atomizing head 5. As shown in FIGS. 1 and 2, a paint passage 9 is provided within the feed tube 8, and the paint passage 9 is connected to a paint supply source 10 and wash fluid supply source (not shown) through, for example, a color changing valve device (not shown). Thus, the feed tube 8 serves to supply paint from the paint supply source 10 toward the rotary atomizing head 5 through the paint passage 9 at the time of coating, and to supply wash fluid (for example, solvent such as thinner, or water, and the like, and/or air, and the like.) from wash fluid supply source at the time of washing and/or at the time of color change.

It is to be noted that the feed tube 8 is not limited to the first embodiment, but may be formed as a double tube such that a paint passage is formed at an inner tube and a wash fluid passage is disposed at an outer tube, for example. Moreover, the paint passage 9 is not limited to a paint passage 9 passing within the feed tube 8 as in the first embodiment, and various kinds of passage forms may be employed in correspondence with the kind of the coater 1.

Further, in the case where an exchangeable cartridge is used at the coater 1 as the paint supply source 10, color changing operation may be performed by changing the cartridge. In this case, color changing valve device is unnecessary.

The paint supply valve 11 is provided in the middle of the paint passage 9, and is constituted with a normally-closed type opening/closing valve. This paint supply valve 11 comprises a valve body 11A extending within the paint passage 9, a piston 11C provided within a cylinder 11B by being positioned on the base end side of the valve body 11A, a valve spring 11D provided within the cylinder 11B and for biasing the valve body 11A in a closing valve direction, and a pressure receiving chamber 11E provided on the side opposite to the valve spring 11D within the cylinder 11B. A supply valve driving air passage 12 extending into the cover 2 is connected to the pressure receiving chamber 11E. The paint supply valve 11 is supplied with supply valve drive air (pilot air) through the supply valve driving air passage 12 to the pressure receiving chamber 11E to open the valve body 11A against the valve spring 11D to permit communication of paint within the paint passage 9.

The air source 13 is connected to the driving air passage 4, the shaping air passage 7 and the supply valve driving air passage 12. This air source 13 serves to suck and compress atmosphere through filter thereafter to dry compressed air by using drier (both members are not illustrated) to deliver the compressed air thus dried. The compressed air delivered from the air source 13 is supplied to the air motor 3 through pneumatic-to-electric transducer (not shown) provided in the middle of the driving air passage 4 so that the number of rotations of the air motor 3 is controlled by using the pneumatic-to-electric transducer, for example. On the other hand, the compressed air delivered from the air source 13 is supplied to the shaping air passage 7 to form a spraying pattern of paint particles, and is supplied to the supply valve driving air passage 12, whereby the compressed air thus supplied is used for opening/closing and driving the paint supply valve 11.

Figure 3:
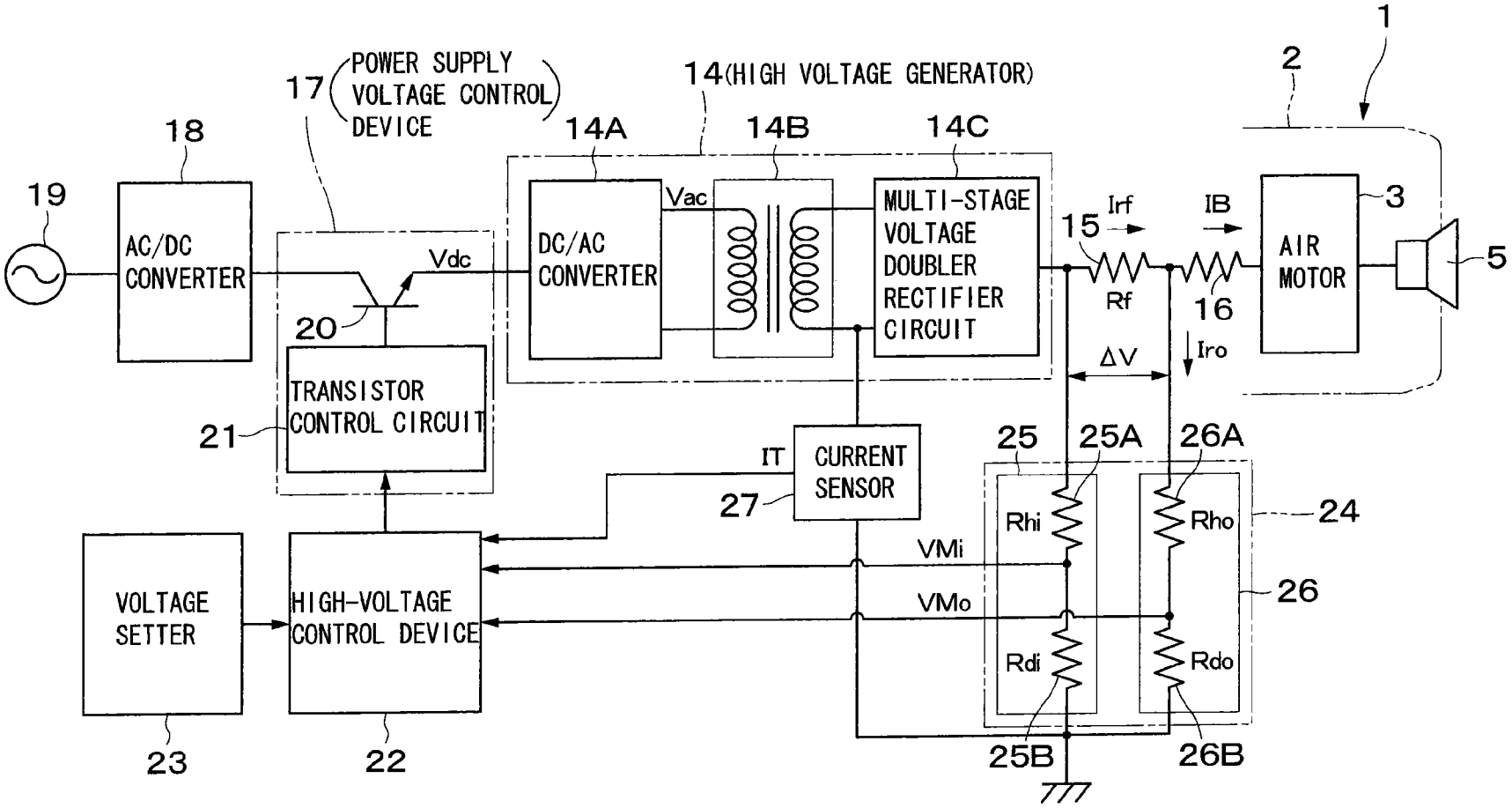
FIG. 3 is an electric circuit diagram of the rotary atomizing head type coating apparatus according to the first embodiment.

The high voltage generator 14 is accommodated in the base end side of the cover 2. This high voltage generator 14 comprises a DC/AC converter 14A, a step up transformer 14B, and a multi-stage voltage doubler rectifier circuit 14C. As shown in FIG. 3, the DC/AC converter 14A serves to convert a DC power supply voltage Vdc outputted from power supply voltage control device 17 which will be described later into an AC primary voltage Vac having a frequency of about several kHz, for example. The primary voltage Vac is raised by the step up transformer 14B. Namely, the primary voltage Vac is inputted to the primary side coil of the step up transformer 14B so that a secondary voltage obtained by elevating the primary voltage Vac is excited on the secondary side coil.

The multi-stage voltage doubler rectifier circuit 14C is constituted with the so-called Cockcraft circuit comprising a plurality of capacitors and a plurality of diodes (both components are not illustrated). The multi-stage voltage doubler rectifier circuit 14C serves to further boost a secondary voltage supplied from the step up transformer 14B to generate a high-voltage of −30 to −150 kV, for example. Further, the high voltage generator 14 serves to directly electrify paint so as to have a high voltage through the air motor 3 and the rotary atomizing head 5.

In this case, the output side of the high voltage generator 14 is connected to the air motor 3 through the current detection resistor 15 and the spark prevention resistor 16. As shown in FIG. 3, the current detection resistor 15 and the spark prevention resistor 16 are connected in series between the high voltage generator 14 and the air motor 3. The current detection resistor 15 is connected to the high voltage generator 14 side rather than the spark prevention resistor 16. For this reason, the input terminal of the current detection resistor 15 is connected to the output terminal of the high voltage generator 14, and the output terminal of the current detection resistor 15 is connected to the spark prevention resistor 16.

A resistance value Rf of the current detection resistor 15 is set to a value such that a sufficient potential difference takes place between both terminals when, for example, a coater current IB of about several ten to several hundred μA is caused to flow. More specifically, the resistance value of the current detection resistor 15 is set to a value of several ten MΩ to several hundred MΩ (for example, 30MΩ to 500MΩ).

The spark prevention resistor 16 serves to prevent that spark takes place between the rotary atomizing head 5 and the coating object A. For this reason, the resistance value of the spark prevention resistor 16 is set to a value (for example, about 30MΩ to 500MΩ) such that a sufficient voltage drop takes place by the coater current IB when the rotary atomizing head 5 and the coating object A are caused to be too close to each other so that the coater current IB is increased.

It should be noted that, in the first embodiment, the spark prevention resistor 16 is provided in a manner different from the current detection resistor 15. However, the present invention is not limited to the same, but the resistance value Rf of current detection resistor 15 may be set as occasion demands to thereby allow the current detection resistor 15 to double as the spark prevention resistor 16, for example. In this case, the spark prevention resistor 16 may be omitted.

The power supply voltage control device 17 serves to control a DC power supply voltage Vdc supplied to the high voltage generator 14 for the purpose of controlling an output voltage (high voltage) outputted from the high voltage generator 14. This power supply voltage control device 17 is adapted so that the input side thereof is connected to a commercial power supply 19 through the AC/DC converter 18 and the output side thereof is connected to the high voltage generator 14.

In this case, the AC/DC converter 18 serves to convert, for example, AC 100V fed from the commercial power supply 19 into a DC power supply voltage Vdc of 24V to output the power supply voltage Vdc to the power supply voltage control device 17, for example.

The power supply voltage control device 17 serves to supply the power supply voltage Vdc to the high voltage generator 14. This power supply voltage control device 17 is configured to comprise, for example, an NPN-type power transistor 20, and a transistor control circuit 21 for controlling the power transistor 20. The collector of the power transistor 20 is connected to the AC/DC converter 18, the emitter of the power transistor 20 is connected to the input side of the high voltage generator 14, and the base of the power transistor 20 is connected to the transistor control circuit 21.

The transistor control circuit 21 serves to change a base voltage of the power transistor 20 in accordance with a signal outputted from high-voltage control device 22 which will be described later to adjustably control the power supply voltage Vdc applied from the emitter to the input side of the high voltage generator 14.

The high-voltage control device 22 is configured to include a processing unit (CPU). This high-voltage control device 22 serves to output a signal (setting signal) corresponding to a setting voltage outputted from the voltage setter 23 in order to set power supply voltage Vdc to the power supply voltage control device 17. A voltage setter 23, a coater current detector 24 and a current sensor 27 are connected to the input side of the high-voltage control device 22. The power supply voltage control device 17 is connected to the output side of the high-voltage control device 22, and an alarm buzzer 28 and an alarm lamp 29 which will be described later are connected thereto.

The high-voltage control device 22 serves to compute, based on a voltage detection value VMi by the input side voltage-dividing circuit 25 of the coater current detector 24, for example, an output voltage outputted from the high voltage generator 14. Further, the high-voltage control device 22 serves to compare a setting voltage outputted from the voltage setter 23 and an output voltage computed from the voltage detection value VMi to perform feed-back control of an output voltage outputted from the high voltage generator 14, for example. Thus, the high-voltage control device 22 serves to output a setting signal to the transistor control circuit 21 to control driving operation of the power transistor 20 to control a high voltage outputted from the high voltage generator 14.

It is assumed that the high-voltage control device 22 serves to compute an output voltage of the high voltage generator 14 based on the voltage detection value VMi by the input side voltage-dividing circuit 25. However, the present invention is not limited to the same, but may serve to compute an output voltage of the high voltage generator 14 by using the voltage detection value VMo by the output side voltage-dividing circuit 26.

Figure 4:
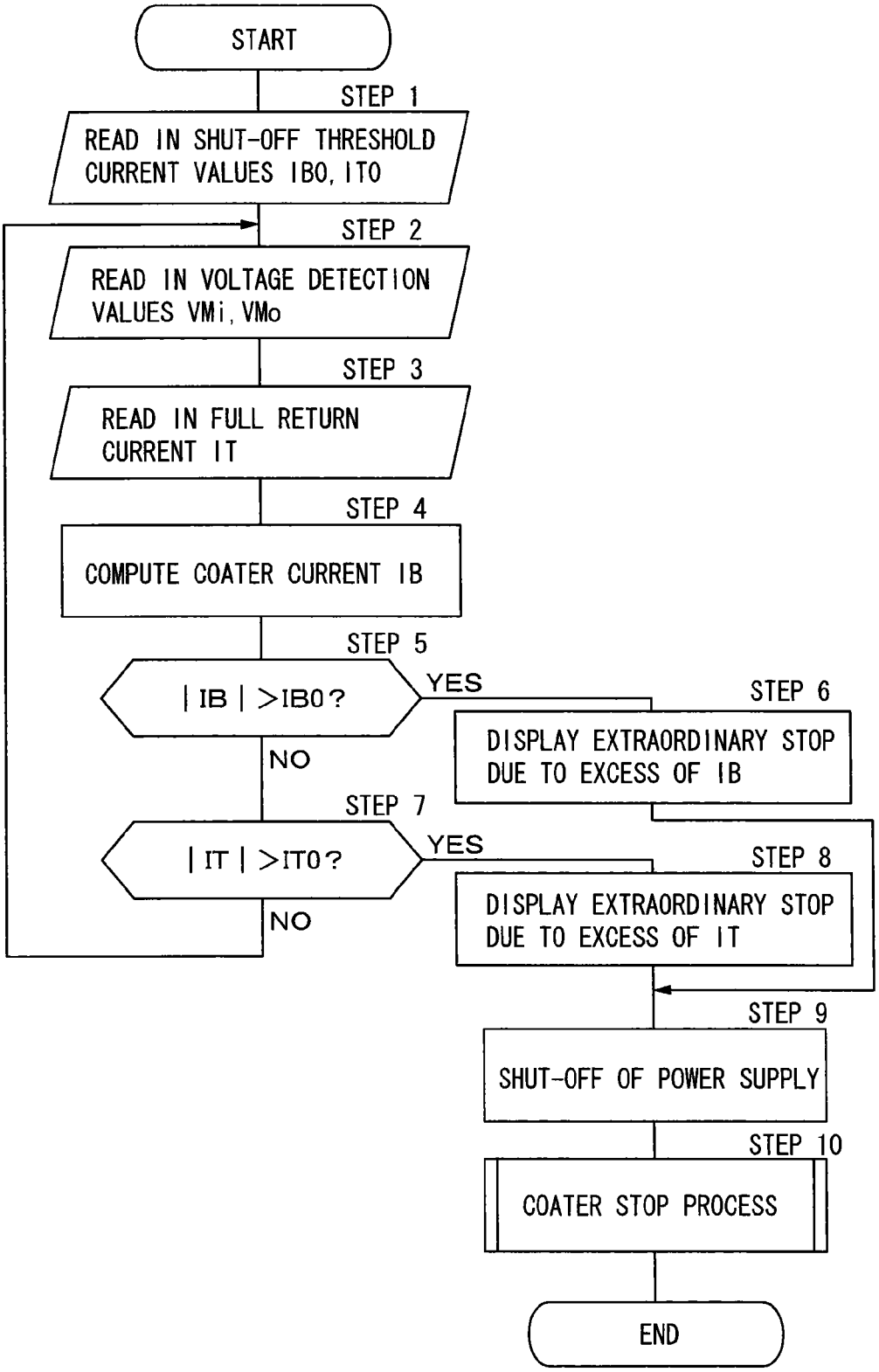
FIG. 4 is a flow chart showing high-voltage generating control process according to the first embodiment.

Moreover, the high-voltage control device 22 is operated in accordance with program of the high-voltage generating control process shown in FIG. 4 which will be described later. Namely, the high-voltage control device 22 has a function to compute coater current IB supplied to the air motor 3 by using voltage detection values VMi, VMo of the input side voltage-dividing circuit 25, the output side voltage-dividing circuit 26, respectively, and a function to discriminate insulating state of the coater 1 by using the coater current IB and the full return current IT. The high-voltage control device 22 serves to output a shut-off signal to the power supply voltage control device 17 to shut off supply of the power supply voltage Vdc to the high voltage generator 14 when it is discriminated that the insulating property is deteriorated.

Thus, the high-voltage control device 22 comprises a power supply shut-off device which outputs a shut-off signal for shutting off supply of the power supply voltage Vdc to the power supply voltage control device 17 when it is discriminated by using the coater current IB that the coater 1 is caused to be extraordinarily close to the coating object A.

It should be noted that a setting voltage outputted from the voltage setter 23 is set as occasion demands within the range of, for example, −30 to −150 kV in accordance with the property of paint and/or coating condition, and the like.

The coater current detector 24 serves to detect coater current IB supplied to the coater 1 based on potential difference ΔV taking place on both terminals of the current detection resistor 15. This coater current detector 24 comprises an input side voltage-dividing circuit 25 and an output side voltage-dividing circuit 26. In addition to the above, as described later, the coater current detector 24 serves to detect coater current IB in accordance with the computational process by the high-voltage control device 22 indicated in the step 4 of FIG. 4. At this time, the computational process in the step 4 corresponds to a coater current computing processor.

The input side voltage-dividing circuit 25 is connected to the input terminal of the current detection resistor 15. Namely, the input side voltage-dividing circuit 25 is connected to the high voltage generator 14 side among the both ends of the current detection resistor 15. The input side voltage-dividing circuit 25 comprises voltage-dividing resistors 25A, 25B, wherein the voltage-dividing resistors 25A, 25B are connected in series between the input terminal of the current detection resistor 15 and the earth. Thus, the input side voltage-dividing circuit 25 serves to divide a high voltage applied to the input terminal of the current detection resistor 15 by a ratio corresponding to resistance values Rhi, Rdi of the voltage-dividing resistors 25A, 25B to detect the voltage detection value VMi.

In this case, in order to lower the voltage detection value VMi, the resistance value Rdi of the voltage-dividing resistor 25B of the earth side is set to a sufficiently small value (for example, one per several thousands to one per one hundred thousands) as compared to the resistance value Rhi of the voltage-dividing resistor 25A of the current detection resistor 15 side. Moreover, in order to reduce currents flowing in these voltage-dividing resistors 25A, 25B as minimum as possible, the total value of the resistance values Rhi, Rdi thereof is set to a sufficiently large value (for example, several hundred MΩ to several GΩ).

The output side voltage-dividing circuit 26 is connected to the output terminal of the current detection resistor 15. Namely, the output side voltage-dividing circuit 26 is connected to the air motor 3 side among the both terminals of the current detection resistor 15. The output side voltage-dividing circuit 26 comprises voltage-dividing resistors 26A, 26B. The voltage-dividing resistors 26A, 26B are connected in series between the output terminal of the current detection resistor 15 and the earth. Thus, the output side voltage-dividing circuit 26 serves to divide a high voltage applied to the output terminal of the current detection resistor 15 by a ratio corresponding to resistance values Rho, Rdo of the voltage-dividing resistors 26A, 26B to detect a voltage detection value VMo.

In this case, in order to lower the voltage detection value VMo, the resistance value Rdo of the voltage-dividing resistor 26B of the earth side is set to a sufficiently small value (for example, one per several thousands to one hundred thousands) as compared to the resistance value Rho of the voltage-dividing resistor 26A of the current detection resistor 15 side. Moreover, the total value of resistance values Rho, Rdo of the voltage-dividing resistors 26A, 26B is set to a sufficiently large value (for example, several hundred MO to several GO) in order to reduce currents flowing in these voltage-dividing resistors as minimum as possible.

A current sensor 27 is connected to the high voltage generator 14 to constitute a full return current detector. This current sensor 27 is positioned on the input side of multi-stage double voltage rectifier circuit 14C, for example, and is connected to the secondary side coil of the step up transformer 14B to detect a current flowing in the secondary side coil. Thus, the current sensor 27 serves to detect a full return current IT flowing in the high-voltage generating path including the high voltage generator 14 to output a detected current value of the full return current IT to the high-voltage control device 22.

The alarm buzzer 28 and the alarm lamp 29 constitute alarm means, and are connected to the output side of the high-voltage control device 22. The alarm buzzer 28 and the alarm lamp 29 are driven based on an alarm signal outputted from the high-voltage control device 22 to notify a worker that the insulating property of the coater 1 has been lowered, and the like.

The rotary atomizing head type coating apparatus according to the first embodiment has a configuration as described above, and the operation as a coating apparatus will now be described.

The coater 1 serves to rotate, at a high speed, the rotary atomizing head 5 by means of the air motor 3 and to deliver paint onto the rotary atomizing head 5 through the feed tube 8 in this state. Thus, the coater 1 serves to atomize and spray paint by the centrifugal force when the rotary atomizing head 5 is rotated to spray it, and to control spraying pattern by being supplied with shaping air through the shaping air ring 6. Thereby, the coater 1 deposits the paint particles onto the coating object A.

Moreover, a high voltage by the high voltage generator 14 is applied to the rotary atomizing head 5 through the air motor 3. Thus, paint particles are directly electrified through the rotary atomizing head 5 so as to have a high voltage, and fly along an electrostatic field formed between the rotary atomizing head 5 and the coating object A so that they are painted and deposited onto the coating object.

Next, the high-voltage generating control process performed by the high-voltage control device 22 will now be described with reference to FIG. 4.

It is to be noted that a shut-off threshold current value IB0 is a current value of coater current IB flowing on the output terminal of the high voltage generator 14 in the state where the atomizing head 5 is caused to be extraordinarily close to the coating object A. This shut-off threshold current value IB0 is set to about several μA to several ten μA, for example.

Moreover, the shut-off threshold current value IT0 is a current value of the full return current IT flowing in the high-voltage generating path including the high voltage generator 14 in the state where the rotary atomizing head 5 is caused to be extraordinarily close to the coating object A. This shut-off threshold current value IT0 is set to about several hundred μA (for example, 200 μA).

In this case, the shut-off threshold current value IT0 is set to a value larger than the shut-off threshold current value IB0 by taking into consideration leakage currents flowing in the voltage-dividing circuits 25, 26 and/or a leakage current flowing in the high voltage generator 14.

In step 1, shut-off threshold current values IB0, IT0 for absolute value detection stored in the memory (not shown) of the high-voltage control device 22 in advance are read in. In the subsequent step 2, a voltage detection value VMi detected by the input side voltage-dividing circuit 25 and a voltage detection value VMo detected by the output side voltage-dividing circuit 26 are read in. In step 3, a current value of the full return current IT detected by the current sensor 27 is read in.

Subsequently, in step 4, the voltage detection values VMi, VMo, resistance values Rhi, Rdi, Rho and Rdo of the voltage-dividing resistors 25A, 25B, 26A and 26B, and the resistance value Rf of the current detection resistor 15 are substituted into following formula 1 to compute coater current IB supplied to the coater 1.

$$IB = \frac{Ki \times VMi - Ko \times VMo}{Rf} - \frac{Ko \times VMo}{Rho + Rdo} \quad \text{[Formula 1]}$$

However, as shown in the formula 2, Ki and Ko respectively denote voltage-dividing ratios of the voltage-dividing circuits 25, 26 in the formula 1. The voltage-dividing ratios Ki and Ko may be values different from each other, or may be the same value. In this case, as shown in the formula 3, numerator of the first term of the right side of the formula 1 corresponds to a potential difference ΔV taking place on both terminals of the current detection resistor 15. As shown in the formula 4, the first term of the right side of the formula 1 corresponds to a current Irf flowing in the current detection resistor 15. As shown in the formula 5, the second term of the right side of the formula 1 corresponds to a current Iro flowing in the output side voltage-dividing circuit 26.

$$Ki = \frac{Rhi + Rdi}{Rdi} \quad \text{[Formula 2]}$$

$$Ko = \frac{Rho + Rdo}{Rdo}$$

$$\Delta V = Ki \times VMi - Ko \times VMo \quad \text{[Formula 3]}$$

$$Irf = \frac{Ki \times VMi - Ko \times VMo}{Rf} \quad \text{[Formula 4]}$$

$$Iro = \frac{Ko \times VMo}{Rho + Rdo} \quad \text{[Formula 5]}$$

Subsequently, in the step 5, it is determined whether an absolute value of coater current IB computed in the step 4 is greater than the shut-off threshold current value IB0 determined in advance (|IB|>IB0). When determination in the step 5 is made as "YES", for example, there results the state where the rotary atomizing head 5 is caused to be extraordinarily close to the coating object A so that the insulating property is deteriorated. Thus, it is considered that a current flowing between the coater 1 and the coating object A is increased to a degree such that the dielectric breakdown can take place. For this reason, process shifts to the step 6 to perform an extraordinary stop display indicating that the absolute value of the coater current IB is excessive. This extraordinary stop display is performed by performing an output to monitor (not illustrated) of the high-voltage control device 22, and by notifying a worker of its output by using the alarm buzzer 28 and the alarm lamp 29.

Thereafter, process shifts to step 9, wherein the high-voltage control device 22 serves to output a shut-off signal to the power supply voltage control device 17 to drive the transistor control circuit 21 to shut off between the high voltage generator 14 and the AC/DC converter 18 to stop supply of high voltage. Finally, in step 10, a process to stop driving operation of the coater 1 is performed to end the processing.

On the other hand, when determination is made as "NO" in step 5, process shifts to step 7. In the step 7, it is determined whether an absolute value of the full return current IT flowing in the high-voltage application path including the high voltage generator 14 is greater than a shut-off threshold current value IT0 determined in advance (|IT|>IT0). When determination is made as "YES" in the step 7, it can be considered that the full return current IT is increased to such a degree that the dielectric breakdown can take place. For this reason, process shifts to step 8 to perform an extraordinary stop display indicating that the absolute value of the full return current IT is excessive. Thereafter, process shifts to step 9.

On the other hand, when determination is made as "NO" in the step 7, since when determination is made as "NO" both in the steps 5, 7, the absolute value of the coater current IB and the absolute value of the full return current IT both become equal to shut-off threshold current values IB0, IT0 or less. For this reason, it is considered that the absolute value of the coater current IB and the absolute value of the full return current IT are small to such a degree that coating can be continuously carried out. Accordingly, process steps subsequent to the step 2 will be repeated.

As described above, in the first embodiment, the high-voltage control device 22 comprises a coater current extraordinary state processor operative to output a shut-off signal when the absolute value of the coater current IB exceeds shut-off threshold current value IB0, and a full return current extraordinary state processor operative to output a shut-off signal when the absolute value of the full return current IT exceeds the shut-off threshold current value IT0. At this time, the coater current extraordinary state processor and the coater current extraordinary state processor constitute a power supply shut-off device.

The rotary atomizing head type coating apparatus according to the first embodiment is operated based on the high-voltage generating control process as described above.

Thus, in the first embodiment, the current detection resistor 15 is connected between the high voltage generator 14 and the coater 1, and there is provided a coater current detector 24 operative to detect coater current IB supplied to the coater 1 based on potential difference ΔV taking place on the both terminals of the current detection resistor 15. At this time, the coater current IB does not include leakage current taking place within the high voltage generator 14. As compared to the full return current IT including such a leakage current, since the coater current IB is adapted so that coating object current IX flowing between the coater 1 and the coating object A is apt to be reflected, it is possible to suitably detect an increase in the coating object current IX based on the coater current IB. For this reason, since the high-voltage control device 22 can suitably discriminate whether the coater 1 is caused to be excessively close to the coating object A by using the coater current IB by the coater current detector 24, even if the distance between the coater 1 and the coating object A is reduced, it is possible to continue supply of high voltage within the range where spark is not produced, for example. As a result, even in the case where coating is performed at a narrow place, it is possible to broaden the movable range of the coater 1. Thus, the workability of coating can be enhanced.

On the other hand, it is possible to detect a voltage applied to both terminals of the current detection resistor 15 by the input side voltage-dividing circuit 25 and the output side voltage-dividing circuit 26. At this time, an input side voltage detection value VMi detected by the input side voltage-dividing circuit 25 and an output side voltage detection value VMo detected by the output side voltage-dividing circuit 26 result in values corresponding to voltages applied to the both terminals of the current detection resistor 15. For this reason, a potential difference ΔV taking place on the both terminals of the current detection resistor 15 by the voltage detection values VMi, VMo is computed, thus to have ability to compute a current Irf flowing in the current detection resistor 15.

Moreover, while a voltage sensor for detecting an output voltage is generally provided in the output side of the high voltage generator 14, the full return current IT includes a leakage current flowing in this voltage sensor. For this reason, since variation amount of the coating object current IX is small as compared to the leakage current even if the coater 1 is caused to close to the coating object A, there is a tendency such that it is difficult to detect an increase in the coating object current IX in the full return current IT.

On the contrary, in the first embodiment, as shown in the formula 1, current Iro flowing in the output side voltage-dividing circuit 26 is subtracted from current Irf flowing in the current detection resistor 15 to compute coater current IB. As a result, whether the coater current IB exceeds the shut-off current value IB0 is determined, thereby making it possible to detect an increase in the coating object current IX without experiencing the influence of current Iro flowing in the output side voltage-dividing circuit 26.

Moreover, since there is provided current sensor 27 for detecting full return current IT flowing in the high-voltage application path including the high voltage generator 14, the high-voltage control device 22 serves to discriminate whether the full return current IT by the current sensor 27 exceeds a predetermined shut-off threshold current value IT0 to have ability to discriminate whether the insulating property of the coater 1 is deteriorated. In addition thereto, since the full return current IT includes leakage current taking place within the high voltage generator 14, it is possible to discriminate based on the full return current IT whether leakage current taking place within the high voltage generator 14 is increased. Thus, the high-voltage control device 22 can discriminate by using the full return current IT whether the coater 1 is caused to be extraordinarily close to the coating object A so that the insulating property of the coater is deteriorated, and can discriminate degradation in insulation of the high voltage generator 14 in addition thereto.

Figure 5:
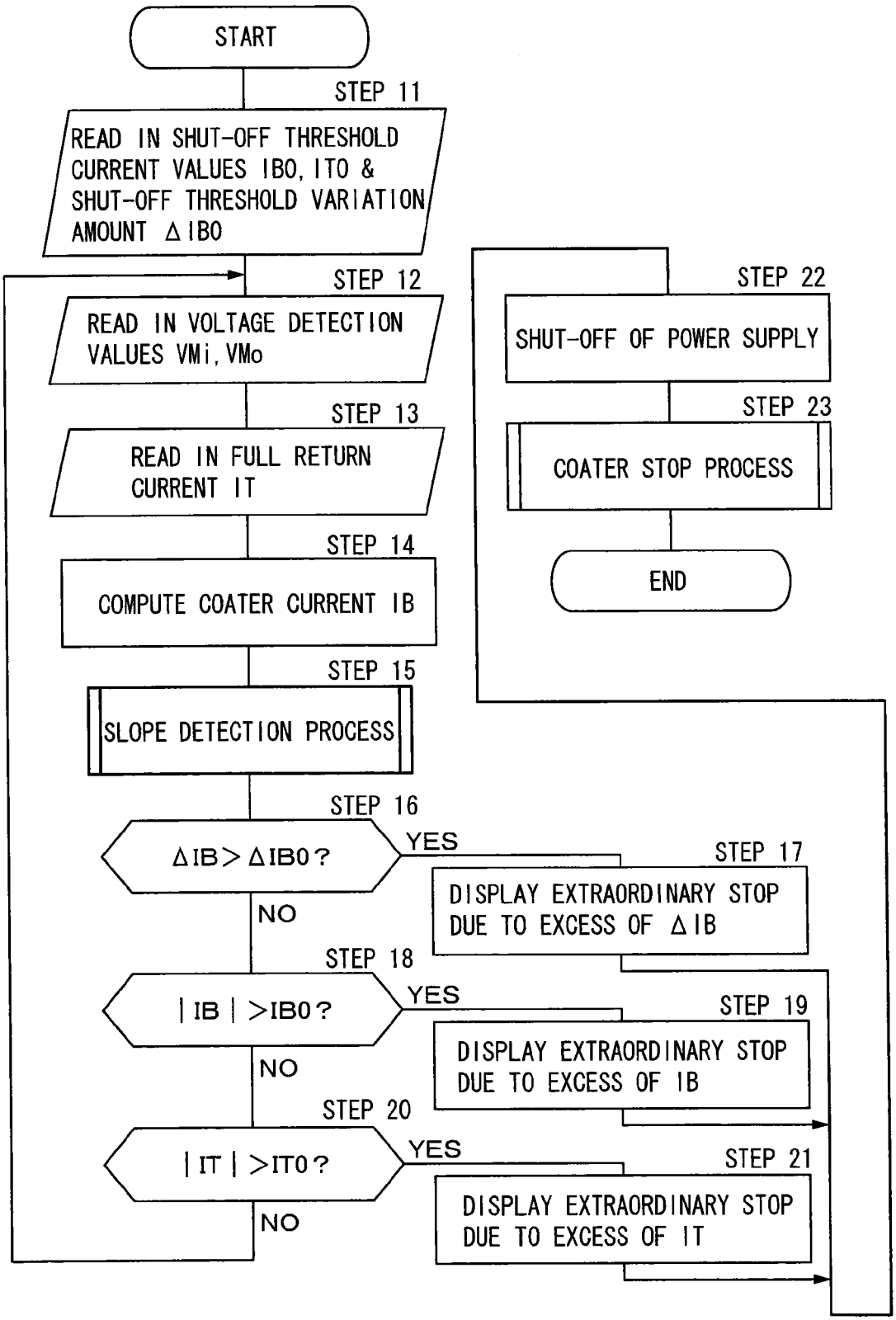
FIG. 5 is a flow chart showing high-voltage generating control process according to a second embodiment.
Figure 6:
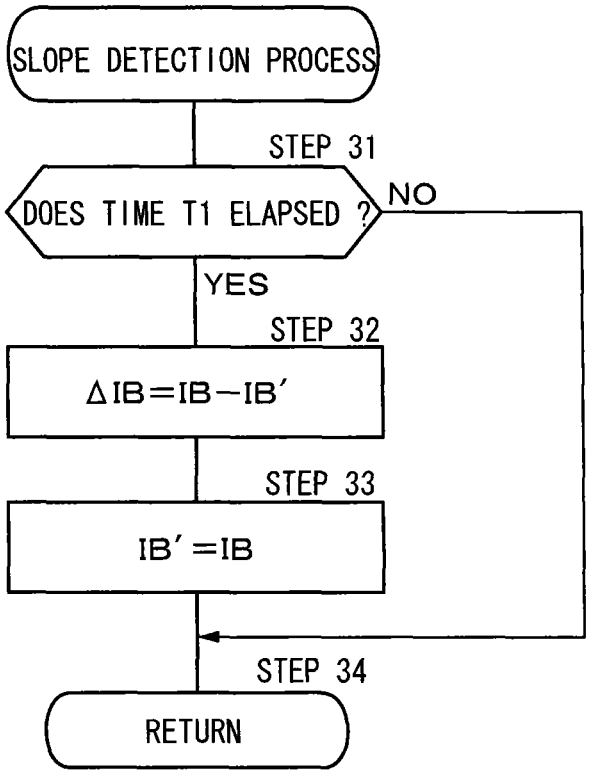
FIG. 6 is a flow chart showing slope detection process in FIG. 5.

Next, FIGS. 5 and 6 illustrate a high-voltage generating control process according to a second embodiment. In the second embodiment, the coater current extraordinary state processor that the high-voltage control device comprises is operative so that when an absolute value of the coater current exceeds a predetermined shut-off threshold current value, or when a variation amount of the coater current exceeds a predetermined shut-off threshold variation amount, it outputs a shut-off signal for shutting off the power supply voltage to the power supply voltage control device. It should be noted that, in the second embodiment, component elements that are identical to those in the foregoing first embodiment will be simply denoted by the same reference numerals to avoid repetitions of similar explanations.

In this case, the shut-off threshold current values IB0, IT0 are set similarly to the first embodiment, and are stored in advance in the memory, and the like (not shown) of the high-voltage control device 22.

The coater current IB' every a predetermined time (for example, every 170 ms) used for slope detection is stored in the memory (not illustrated) of the high-voltage control device 22. The shut-off threshold variation amount ΔIB0 is a variation amount ΔIB of a coater current when the rotary atomizing head 5 is caused to be extraordinarily close to the coating object. This shut-off threshold variation amount ΔB0 is set to a value of about 4 to 40 μA (for example, about 15 μA), and is stored in the memory of the high-voltage control device 22.

In step 11, shut-off threshold current values IB0, IT0 for absolute value detection and shut-off threshold variation amount ΔIB0 which are stored in advance in the memory are read in. In the subsequent step 12, the voltage detection value VMi detected by the input side voltage-dividing circuit 25 and the voltage detection value VMo detected by the output side voltage-dividing circuit 26 are read in. In step 13, a current value of the full return current IT detected by the current sensor 27 is read in.

Subsequently, in step 14, a process similar to the step 4 according to the first embodiment is implemented. Namely, in the step 14, voltage detection values VMi, VMo, resistance values Rhi, Rdi, Rho and Rdo of the voltage-dividing resistors 25A, 25B, 26A and 26B, and resistance value Rf of the current detection resistor 15 are substituted into the previously described formula 1 to compute the coater current IB.

Subsequently, in step 15, slope detection process which will be described later is performed to compute variation amount ΔIB of the coater current every predetermined time T1 determined in advance to shift to step 16.

In step 16, it is determined whether a variation amount ΔIB of the coater current is greater than shut-off threshold variation amount ΔIB0 determined in advance (ΔIB>ΔIB0). When determination is made as "YES" in the step 16, it is considered that there is a tendency such that, for example, the rotary atomizing head 5 is caused to be extraordinarily close to the coating object A, and a current flowing between the coater 1 and the coating object A is increased to much degree in a short time. For this reason, process shifts to step 17 to perform an extraordinary stop display indicating that variation amount ΔIB of the coater current is excessive. Thereafter, process shifts to step 22.

In the step 22, the transistor control circuit 21 is driven to disconnect between high voltage generator 14 and the AC/DC converter 18 to stop supply of the high voltage. In the subsequent step 23, a process to stop driving operation of the coater 1 is implemented to end the process.

On the other hand, when determination is made as "NO" in the step 16, process shifts to step 18. In the step 18, it is determined whether the absolute value of the coater current IB is greater than shut-off threshold current value IB0 determined in advance (|IB|>IB0). When determination is made as "YES" in the step 18, process shifts to step 19 to perform an extraordinary stop display indicating that the absolute value of the coater current IB is excessive. Thereafter, process shifts to step 22.

On the other hand, when determination is made as "NO" in the step 18, process shifts to step 20. In the step 20, it is determined whether an absolute value of the full return current IT flowing in the high-voltage application path including the high voltage generator 14 is greater than the shut-off threshold current value IT0 determined in advance (|IT|>IT0). Consequently, when determination is made as "YES" in the step 20, process shifts to step 21 to perform an extraordinary stop display indicating that an absolute value of the full return current IT is excessive. Thereafter, process shifts to step 22.

On the other hand, when determination is made as "NO" in the step 20, since determination is made as "NO" in all of the steps 16, 18 and 20, a variation amount ΔIB of the coater current is equal to the shut-off threshold variation amount ΔIB0 or less, and the absolute value of the coater current IB and the absolute value of the full return current IT are both respectively equal to shut-off threshold current values IB0 and IT0 or less. For this reason, since it is considered that the variation amount ΔIB of the coater current, the absolute value of the coater current IB and the absolute value of the full return current IT are all small to a degree such that coating can be continued, process steps of the step 12 and subsequent thereto will be repeated.

Next, the slope detection process in the step 15 will now be described with reference to FIG. 6. In step 31, it is determined whether, for example, a setting time T1 of 170 ms is elapsed as time T1 which is set in advance for detecting change in time of current. When determination in step 31 is made as "NO", process shifts to step 34 to perform return as it is. In this case, the setting time T1 may be set as occasion demands in accordance with coating condition, and the like without being limited to 170 ms.

On the other hand, when determination is made as "YES" in the step 31, process shifts to step 32 to compute a difference between the last time coater current IB and the previous (before 170 ms) coater current IB' based on the following the formula 6 to compute this difference as a variation amount ΔIB of the coater current for slope detection. Thereafter, process shifts to step 33 to update (IB'=IB) the previous coater current IB' stored in the memory into the last time coater current IB to shift to step 34 to perform return. Thus, a variation amount ΔIB of the coater current every setting time T1 is computed. In this case, the coater currents IB, IB' ordinarily have the same polarity. For this reason, an increment of an absolute value of the coater current IB may be computed as a variation amount MB of the coater current.

$$\Delta IB = IB - IB' \quad \text{[Formula 6]}$$

Thus, also in the second embodiment, it is possible to obtain operational effects similar to those of the first embodiment. In the second embodiment, there is employed such a configuration adapted so that when a variation amount ΔIB of the coater current exceeds a predetermined shut-off threshold variation amount ΔIB0, it outputs a shut-off signal for shutting off supply of power supply voltage Vdc to the power supply voltage control device 17. For this reason, it is possible to discriminate by using variation amount ΔIB of the coater current whether the coater 1 is caused to be extraordinarily close to the coating object A. Consequently, when the coater 1 is caused to be extraordinarily close to the coating object A, it is possible to shut off supply of the power supply voltage Vdc to the high voltage generator 14.

Further, in the case where whether the coater is caused to be ordinarily close to the coating object A is discriminated by using variation amount of the full return current as in the conventional art, there are problems as described below. Namely, even when the coater 1 is caused to be close to the coating object A so that coating object current IX is changed, the change of the coating object current IX is weakened based on a leakage current taking place within the high voltage generator 14, or a leakage current flowing in a circuit for determining an output voltage of the high voltage generator 14, resulting in the problem that precision is easy to be lowered.

On the contrary, in the second embodiment, since it is discriminated whether the coater 1 is caused to be extraordinarily close to the coating object A by using variation amount MB of the coater current except for such leakage currents, it is possible to grasp access state of the coating object A with high precision. For this reason, it is possible to avoid unnecessary interruption of coating. Thus, the productivity of coating can be enhanced.

Figure 7:
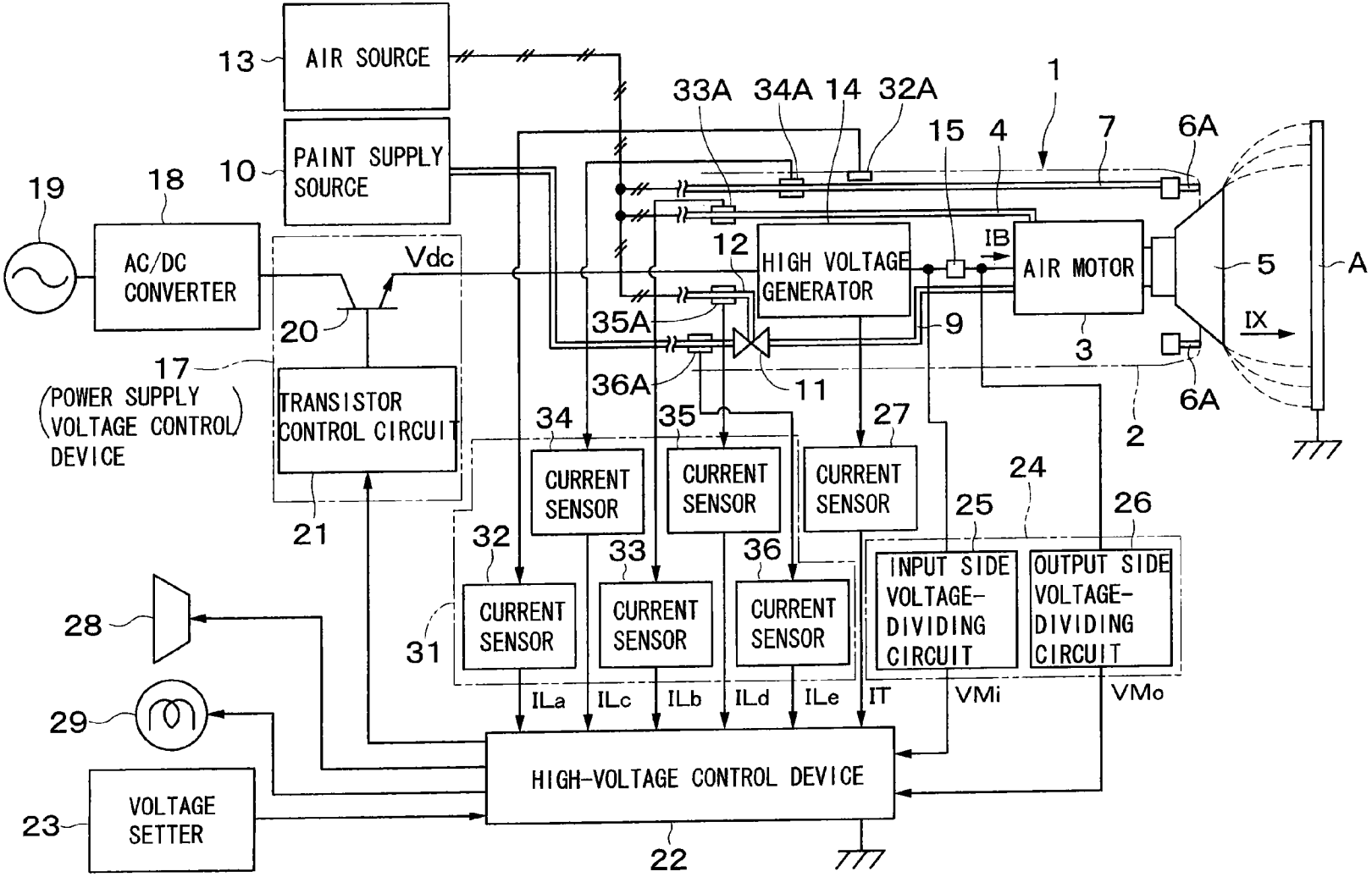
FIG. 7 is a diagram showing the entire configuration of a rotary atomizing head type coating apparatus according to a third embodiment.
Figure 8:
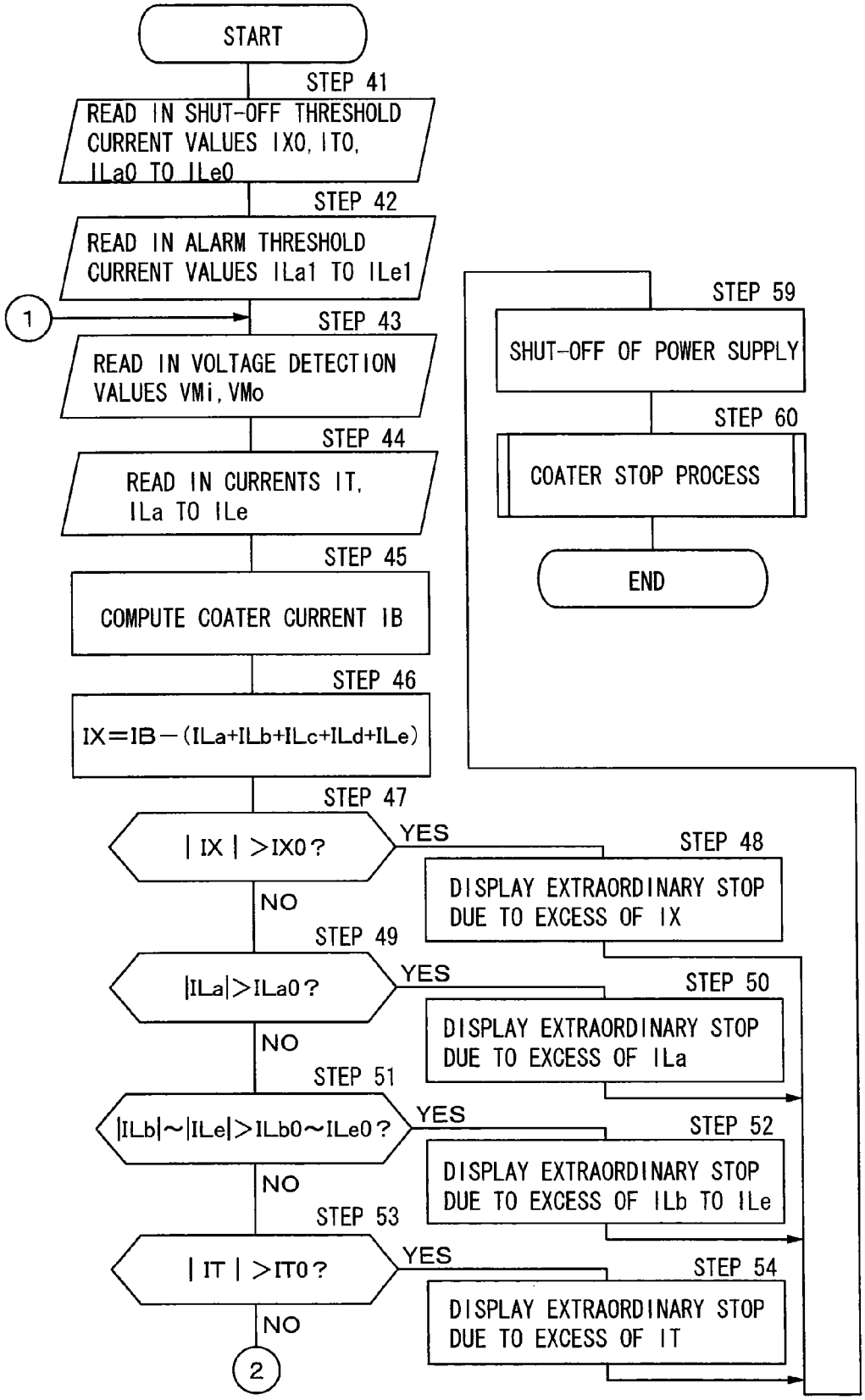
FIG. 8 is a flow chart showing high-voltage generating control process according to the third embodiment.
Figure 9:
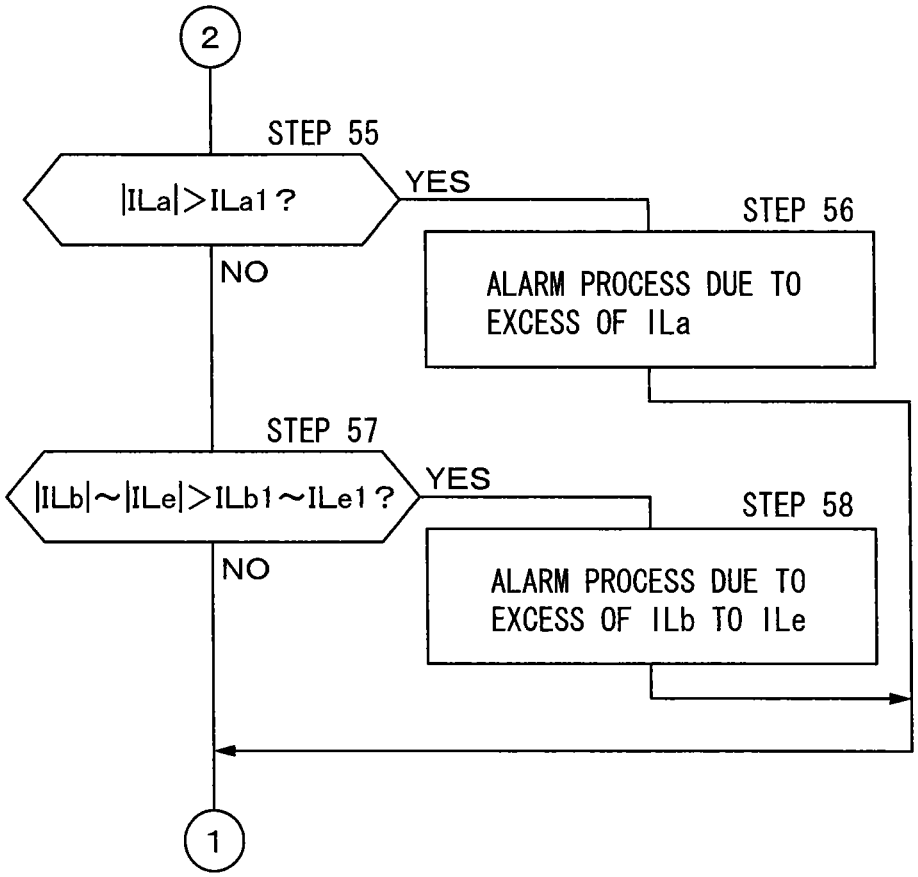
FIG. 9 is a flow chart subsequent to FIG. 8.

Next, FIGS. 7 to 9 illustrate a third embodiment according to the present invention. In the third embodiment, the coating apparatus further comprises a leakage current detector for detecting a leakage current produced in the coater, and the high-voltage control device comprises a coating object current computing processor, a coating object current extraordinary state processor, and an insulation deterioration alarm processor. In the third embodiment, the high-voltage control device comprises a coating object current extraordinary state processor in place of the coater current extraordinary state processor. This coating object current extraordinary state processor constitutes a power supply shut-off device. In addition, in the third embodiment, component elements that are identical to those in the foregoing first embodiment will be simply denoted by the same reference numerals to avoid repetitions of similar explanations.

The leakage current detector 31 serves to detect a leakage current flowing without passing through the coating object A. This leakage current detector 31 is comprised of current sensors 32 to 36 which will be described later, wherein each output side thereof is connected to the high-voltage control device 22.

The current sensor 32 constitutes an external surface current detector. This current sensor 32 is connected to an annular conducting terminal 32A made of conductive metallic material, and the like provided on the surface of the cover 2, for example. The current sensor 32 serves to detect a leakage current ILa flowing on the external surface of the coater 1 (the surface of the cover 2) through the conducting terminal 32A to output a current value of the detected leakage current ILa to the high-voltage control device 22.

The current sensor 33 constitutes a driving air passage current detector. This current sensor 33 is connected to an annular conducting terminal 33A made of conductive metallic material, and the like, provided in the middle of the driving air passage 4, for example. The current sensor 33 serves to detect a leakage current ILb flowing in the driving air passage 4 within the coater 1 through the conducting terminal 33A to output a current value of the detected leakage current ILb to the high-voltage control device 22.

The current sensor 34 constitutes a shaping air passage current detector. This current sensor 34 is connected to an annular conducting terminal 34A made of conductive metallic material, and the like provided in the middle of the shaping air passage 7, for example. The current sensor 34 serves to detect a leakage current ILc flowing in the shaping air passage 7 within the coater 1 through the conducting terminal 34A to output a current value of the detected leakage current ILc to the high-voltage control device 22.

The current sensor 35 constitutes a supply valve driving air passage current detector. This current sensor 35 is connected to an annular conducting terminal 35A made of conductive metallic material, and the like provided in the middle of the supply valve driving air passage 12, for example. The current sensor 35 serves to detect a leakage current ILd flowing in the supply valve driving air passage 12 within the coater 1 through the conducting terminal 35A to output a current value of the detected leakage current ILd to the high-voltage control device 22.

The current sensor 36 constitutes a paint passage current detector. This current sensor 36 is connected to an annular conducting terminal 36A made of conductive metallic material, and the like provided in the middle of the paint passage 9 in the state positioned on the upstream side (paint supply source 10 side) relative to the paint supply valve 11, for example. The current sensor 36 serves to detect a leakage current ILe flowing in the paint passage 9 within the coater 1 through the conducting terminal 36A to output a current value of the detected leakage current ILe to the high-voltage control device 22.

The high-voltage generating control process according to the third embodiment will now be described with reference to FIGS. 8 and 9.

It should be noted that, shut-off threshold current values IX0, IT0, ILa0 to ILe0, and alarm threshold current values ILa1 to ILe1 are stored in advance in the memory, and the like (not illustrated) of the high-voltage control device 22.

In this case, the shut-off threshold current value IX0 is a coating object current value flowing between the coater 1 and the coating object A in the state where the rotary atomizing head 5 is caused to be extraordinarily close to the coating object A so that the insulating property is deteriorated. This shut-off threshold current value IX0 is set to about 80 μA, for example.

The shut-off threshold current value ILa0 is a current value flowing on the external surface of the cover 2 in the state where the insulating property of the cover 2 is deteriorated. This shut-off threshold current value ILa0 is set to about 60 μA, for example.

The shut-off threshold current values ILb0 to ILd0 are current values flowing in the respective air passages 4, 7, 12 in the state where the insulating property of each of air passages 4, 7, 12 is deteriorated. These shut-off threshold current values ILb0 to ILd0 are set to about 10 μA, for example.

The shut-off threshold current value ILe0 is a current value flowing in the paint passage 9 in the state where the insulating property of the paint passage 9 is deteriorated. This shut-off threshold current value ILe0 is set to about 15 μA, for example.

Moreover, the alarm threshold current value ILa1 is a current value flowing on the external surface of the cover 2 at the initial stage where the insulating property of the cover 2 is lowered. This alarm threshold current value ILa1 is set to about 40 μA, for example, as a value smaller than the shut-off threshold current value ILa0.

The alarm threshold current values ILb1 to ILd1 are current values flowing in the respective air passages 4, 7, 12 at the initial stage where the insulating property of each of the air passages 4, 7, 12 is lowered. These alarm threshold current values ILb1 to ILd1 are set to about 6 μA, for example, as a value smaller than the shut-off threshold current values ILb0 to ILd0.

The alarm threshold current value ILe1 is a current value flowing in the paint passage 9 at the initial stage where the insulating property of the paint passage 9 is lowered. This alarm threshold current value ILe1 is set to about 10 μA, for example, as a value smaller than shut-off threshold current value ILe0. As described above, the alarm threshold current values ILa1 to ILe1 are set to values of about 60% to 80% of shut-off threshold current values ILa1 to ILe1, for example.

In FIG. 8, in step 41, shut-off threshold current values IX0, IT0, ILa0 to ILe0 for absolute value detection stored in the memory in advance are read in. In step 42, alarm threshold current values ILa1 to ILe1 for absolute value detection stored in the memory in advance are read in. In the subsequent step 43, a voltage detection value VMi detected by the input side voltage-dividing circuit 25 and voltage detection value VMo detected by the output side voltage-dividing circuit 26 are read in. In the step 44, the full return current IT and leakage currents ILa to ILe detected by the current sensors 27, 32 to 36 are read in.

Subsequently, in step 45, a process similar to the step 4 according to the first embodiment is implemented. Namely, in the step 45, the voltage detection values VMi, VMo, the resistance values Rhi, Rdi, Rho, Rdo of the voltage-dividing resistors 25A, 25B, 26A, 26B and the resistance value Rf of the current detection resistor 15 are substituted into the previously described formula 1 to compute a coater current IB.

Subsequently, in step 46, a coating object current IX flowing between the coater 1 and the coating object A is computed based on the following formula 7. More specifically, leakage currents ILa to ILe are subtracted from the coater current IB to compute coating object current IX.

$$IX=IB-(ILa+ILb+ILc+ILd+ILe) \quad \text{[Formula 7]}$$

Subsequently, in step 47, it is determined whether an absolute value of coating object current IX computed in the step 46 is greater than shut-off threshold current value IX0 determined in advance (|IX|>IX0). When determination is made as "YES" in the step 47, it is considered that there results the state where the rotary atomizing head 5 is caused to be extraordinarily close to the coating object A so that the insulating property is deteriorated, for example, and a current flowing between the coater 1 and the coating object A is increased to a degree such that the dielectric breakdown can take place. For this reason, process shifts to step 48 to perform an extraordinary stop display indicating that the absolute value of the coating object current IX is excessive. Thereafter, process shifts to step 59.

In the step 59, the transistor control circuit 21 is driven to shut off between the high voltage generator 14 and the AC/DC converter 18 to stop supply of high voltage. In the subsequent step 60, a process for stopping driving operation of the coater 1 is implemented to end the process.

On the other hand, when determination is made as "NO" in the step 47, process shifts to the step 49. In the step 49, it is determined whether the absolute value of the leakage current ILa flowing on the surface of the cover 2, and the like is greater than shut-off threshold current value ILa0 determined in advance (|ILa|>ILa0). When determination is made as "YES" in the step 49, it is considered that there results the state where a creeping discharge takes place by adsorbed material attached to the cover 2, and the like, for example, so that the insulating property is deteriorated, and a current flowing on the surface of the cover 2 is increased to a degree such that the dielectric breakdown can take place. For this reason, process shifts to step 50 to perform an extraordinary stop display indicating that the absolute value of the leakage current ILa detected on the surface of the cover 2 is excessive. Thereafter, process shifts to step 59.

On the other hand, when determination is made as "NO" in the step 49, process shifts to step 51. In the step 51, it is determined whether absolute values of leakage currents ILb to ILd flowing in the air passages 4, 7, 12 and an absolute value of leakage current ILe flowing in the paint passage 9 are respectively greater than shut-off threshold current values ILb0 to ILe0 determined in advance (|ILb|>ILb0, |ILc|>ILc0, |ILd|>ILd0, |ILe|>ILe0). When determination is made as "YES" in the step 51, it is considered that there results the state where creeping discharge takes place by moisture, dust, and the like, attached in the air passages 4, 7, 12, for example, so that insulating property is lost, or there results the state where creeping discharge takes place by pigment, and the like attached in the paint passage 9 so that the insulating property is deteriorated, and either one of currents is increased to a degree such that the dielectric breakdown can take place. For this reason, process shifts to step 52 to perform an extraordinary stop display for specifying a passage or passages of leakage currents ILb to ILe which have been excessive among the leakage currents ILb to ILe. Thereafter, process shifts to the step 59.

On the other hand, when determination is made as "NO" in the step 51, process shifts to step 53. In the step 53, it is determined whether an absolute value of a full return current IT flowing in the high-voltage application path including the high voltage generator 14 is greater than a shut-off threshold current value IT0 determined in advance (|IT|>IT0). When determination is made as "YES" in the step 53, it is considered that the full return current IT is increased to a degree such that the dielectric breakdown can take place. For this reason, process shifts to step 54 to perform an extraordinary stop display indicating that an absolute value of the full return current IT is excessive. Thereafter, process shifts to step 59.

On the other hand, when determination is made as "NO" in the step 53, since determination is made as "NO" in all of the steps 47, 49, 51 and 53, both the absolute values of the currents ILa to ILe, IT and the absolute value of the coating object current IX are equal to shut-off threshold current values ILa0 to ILe0, IT0, IX0 or less. For this reason, since it is considered that currents ILa to ILe, IT and coating object current IX are small to a degree such that coating can be continued, process shifts to step 55.

Subsequently, in step 55, it is determined whether an absolute value of leakage current ILa flowing on the surface of the cover 2, and the like is greater than the alarm threshold current value ILa1 determined in advance (|ILa|>ILa1). When determination is made as "YES" in the step 55, it is considered that while continuation of coating can be performed, the creeping discharge takes place by adsorbed material attached to the cover 2 so that the insulating property is lowered, for example. For this reason, process shifts to step 56 to output an alarm signal to the alarm buzzer 28 and the alarm lamp 29. In addition thereto, the fact that the leakage current ILa is increased so that the insulating property of the cover 2 is lowered is displayed on monitor, and the like (not illustrated) of high-voltage control device 22, for example. By these alarm processes, the worker is hastened to perform maintenance (inspection, cleaning, and the like) of the surface of the cover 2. Thereafter, process steps subsequent to the step 43 will be repeated.

On the other hand, when determination is made as "NO" in the step 55, process shifts to step 57. In the step 57, it is determined whether absolute values of leakage current ILb to ILd flowing in air passages 4, 7, 12 and an absolute value of leakage current ILe flowing in the paint passage 9 are respectively greater than alarm threshold current values ILb1 to ILe1 determined in advance (|ILb|>ILb1, |ILc|>ILc1, |ILd|>ILd1, |ILe|>ILe1).

When determination is made as "YES" in the step 57, it is considered that while continuation of coating can be performed, there results the state where creeping discharge takes place by moisture, dust, and the like attached, for example, within the air passages 4, 7, 12 so that the insulating property is lowered, or there results the state where the creeping discharge takes place by pigment, and the like attached within the paint passage 9 so that the insulating property is lowered. For this reason, process shifts to step 58 to output an alarm signal to the alarm buzzer 28 and the alarm lamp 29. In addition thereto, the passage where the insulating property has been lowered among the air passages 4, 7, 12 and the paint passage 9 is displayed on monitor, and the like (not illustrated) of the high-voltage control device 22, for example. By these alarm processes, the worker is caused to notify that the passage where the insulating property has been lowered among the air passages 4, 7, 12 and the paint passage 9, and is hastened to perform maintenance of the concerned passage, and the like. Thereafter, process steps subsequent to the step 43 will be repeated.

On the other hand, when determination is made as "NO" in the step 57, it is considered that all leakage currents ILa to ILe are smaller than alarm threshold current values ILa1 to ILe1 so that there is maintained ordinary coating state. For this reason, the state as it is held to shift to step 43 to repeat process subsequent to the step 43.

Thus, also in the third embodiment constituted in this way, it is possible to obtain operational effects substantially similar to those of the previously described first embodiment. In the third embodiment, since there is provided leakage current detector 31 for detecting leakage current flowing without passing through the coating object A, leakage currents ILa to ILe are subtracted from the coater current IB thus to have ability to compute a coating object current IX flowing between the coater 1 and the coating object A. For this reason, whether an absolute value of the coating object current IX exceeds a predetermined shut-off threshold current value IX0 is discriminated, thereby making it possible to discriminate whether the coater 1 is caused to be close to the coating object A. As a result, even when a leakage current which is not passed through the coating object A is increased, it is possible to precisely grasp a coating object current IX flowing between the coater 1 and the coating object A. Thus, it is possible to more precisely discriminate by using the coating object current IX whether that coater 1 is caused to be extraordinarily close to the coating object A so that the insulating property of the coater 1 is deteriorated.

Moreover, the high-voltage control device 22 serves to discriminate whether absolute values of leakage currents ILa to ILe by the leakage current detector 31 exceed predetermined alarm threshold current values ILa1 to ILe1, which are smaller than predetermined shut-off threshold current values ILa0 to ILe0, thereby making it possible to discriminate whether the insulating property of the coater has been deteriorated to a degree such that the dielectric breakdown can take place. Thus, the high-voltage control device 22 can grasp development state of the dielectric breakdown at portions except for parts between the coater 1 and the coating object A (for example, the surface of the cover 2 of the coater 1, the internal surface of the paint passage 9, and/or internal surfaces of air passages 4, 7, 12, and the like) by using leakage currents ILa to ILe. For this reason, before damage due to creeping discharges at these respective portions are developed, insulation deterioration is notified by occurrence of alarm, and the like, for example, thus to have ability to hasten a worker to perform maintenance (inspection, cleaning, and the like) of the coater 1. Thus, damage of the coater 1 is prevented to thereby have ability to enhance reliability and durability.

Figure 10:
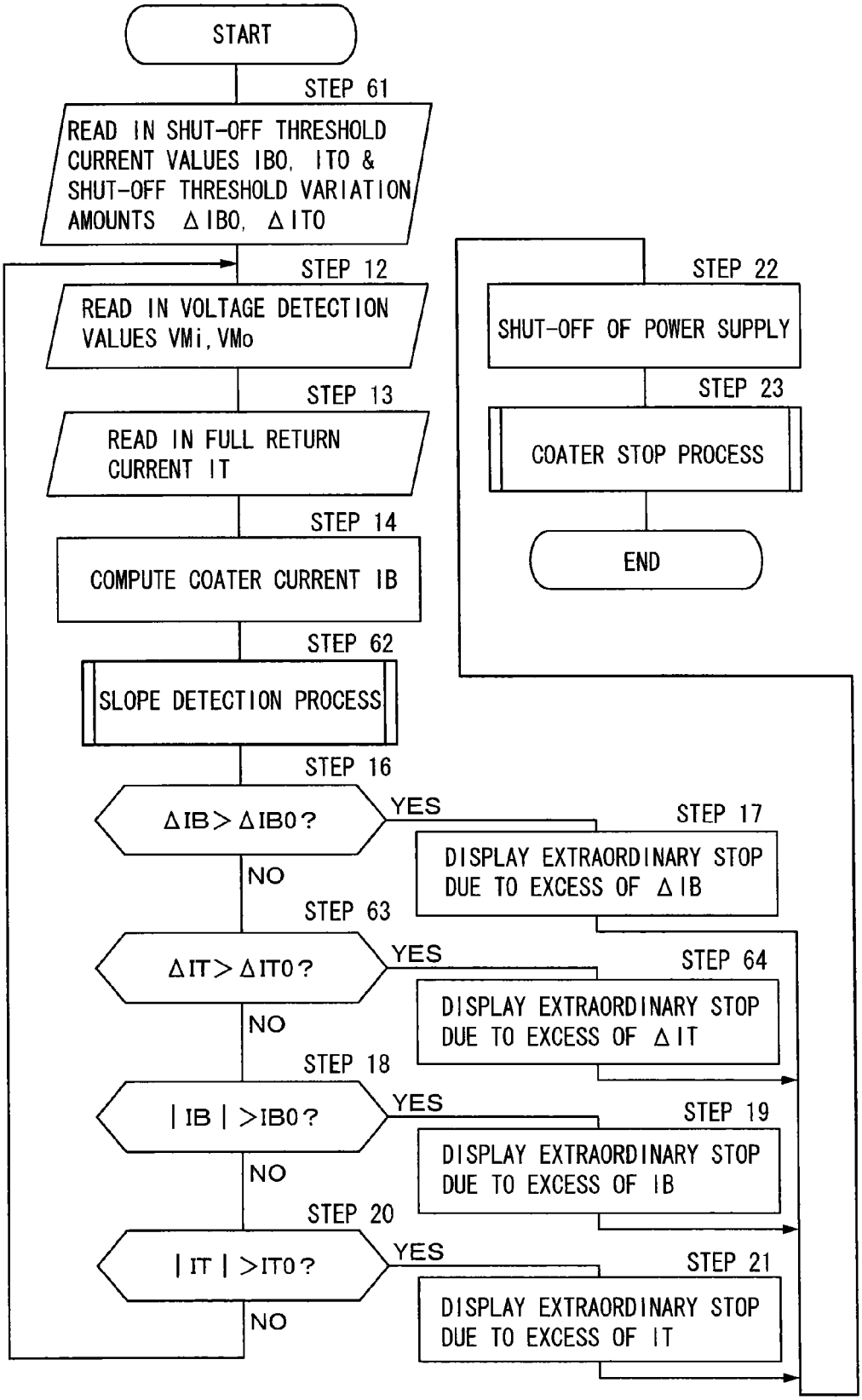
FIG. 10 is a flow chart showing high-voltage generating control process according to a fourth embodiment.
Figure 11:
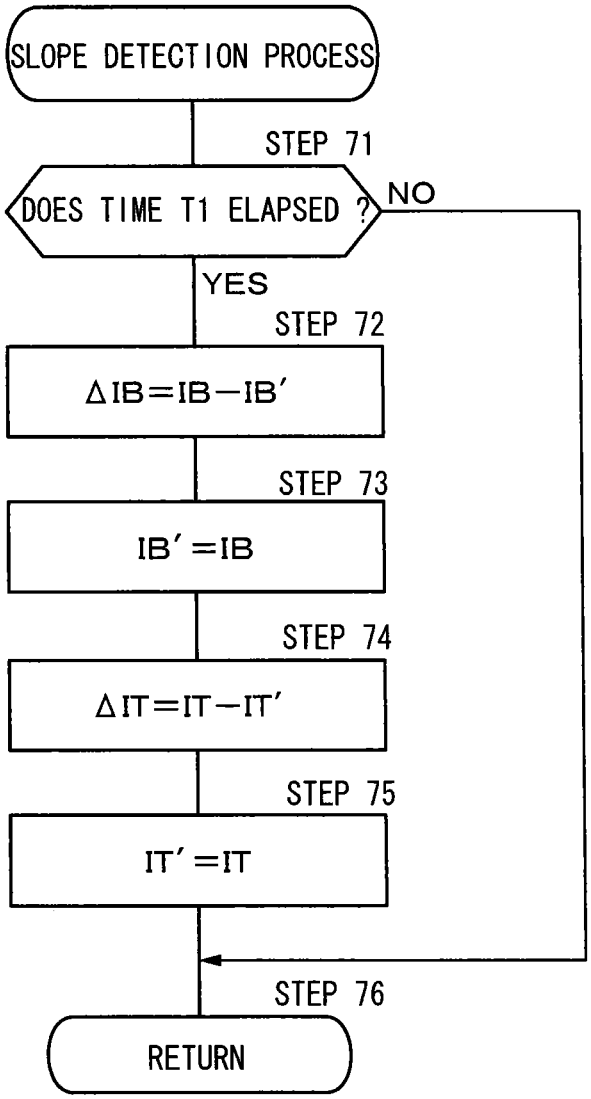
FIG. 11 is a flow chart showing slope detection process in FIG. 10.

Next, FIGS. 10 and 11 show high-voltage generating control process according to a fourth embodiment. In the fourth embodiment, a full return current extraordinary state processor that the high-voltage control device comprises is operative so that when an absolute value of the full return current exceeds a predetermined shut-off threshold current value, or when a variation amount of the full return current exceeds a predetermined shut-off threshold variation amount, it outputs a shut-off signal for shutting off supply of a power supply voltage to the power supply voltage control device. It should be noted that in the fourth embodiment, component elements that are identical to those in the foregoing second embodiment will be simply denoted by the same reference numerals to avoid repetitions of similar explanations.

In this embodiment, shut-off threshold current values IB0, IT0 are set similarly to the first embodiment, and are stored in advance in the memory, and the like (not illustrated) of the high-voltage control device 22.

A full return current IT' and a coater current IB' every predetermined time (for example, every 170 ms) used for slope detection are stored in advance in the memory (not illustrated) of the high-voltage control device 22.

The shut-off threshold variation amount ΔIT0 is a variation amount ΔIT of the full return current when the rotary atomizing head 5 is caused to be extraordinarily close to a coating object. This shut-off threshold variation amount ΔIT0 is set to a value of about 4 to 40 μA (for example, about 15 μA), and is stored in the memory of the high-voltage control device 22. A shut-off threshold variation amount ΔIB0 is a variation amount ΔIB of the coater current when the rotary atomizing head 5 is caused to be extraordinarily close to the coating object. This shut-off threshold variation amount ΔIB0 is set to a value of about 4 to 40 μA (for example, about 15 μA), and is stored in the memory of the high-voltage control device 22. The shut-off threshold variation amounts ΔIT0, ΔIB0 may be the same value to each other, and may be values different from each other.

In step 61, the shut-off threshold current values IB0, IT0 and shut-off threshold variation amounts ΔIB0, ΔIT0 for detection of absolute values stored in advance in the memory are read in. Thereafter, in step 12, voltage detection value VMi and voltage detection value VMo are read in. In step 13, a current value of a full return current IT is read in. In subsequent step 14, a coater current IB is computed based on the voltage detection values VMi, VMo, and the like.

Subsequently, in step 62, slope detection process which will be described later is performed to compute a variation amount ΔIB of the coater current and a variation amount ΔIT of the full return current every predetermined time T1 determined in advance, and process shifts to step 16.

In step 16, it is determined whether the variation amount ΔIB of the coater current is greater than a shut-off threshold variation amount ΔIB0 determined in advance (ΔIB>ΔIB0). When determination is made as "YES" in the step 16, process shifts to step 17 to perform an extraordinary stop display indicating that the variation amount ΔIB of the coater current is excessive. Thereafter, process steps of steps 22 and 23 are performed.

On the other hand, when determination is made as "NO" in the step 16, process shifts to step 63. In the step 63, it is determined whether variation amount ΔIT of the full return current is greater than a shut-off threshold variation amount ΔIT0 determined in advance (ΔIT>ΔIT0). When determination is made as "YES" in the step 63, process shifts to step 64 to perform an extraordinary stop display indicating that variation amount ΔIT of the full return current is excessive. Thereafter, process steps of steps 22 and 23 are performed.

On the other hand, when determination is made as "NO" in the step 63, process shifts to step 18. The process steps of the steps 18 to 23 are similar to those of the second embodiment.

Next, the slope detection process of the step 62 will be described with reference to FIG. 11. In step 71, it is determined whether a setting time T1 of about 170 ms, for example, is elapsed as a time T1 set in advance for detecting change in time of current. When determination is made as "NO" in the step 71, process shifts to step 76 to perform return as it is. It should be noted that the setting time T1 is set as occasion demands in accordance with coating condition, and the like without being limited to 170 ms.

On the other hand, when determination is made as "YES" in step 71, process shifts to step 72 to compute a difference between the last time coater current IB and the previous (before 170 ms) coater current IB' based on the previously described formula 6 to compute this difference as a variation amount ΔIB of the coater current for slope detection. Thereafter, process shifts to step 73 to update the previous coater current IB' stored in the memory into the last time coater current IB (IB'=IB).

In the subsequent step 74, a difference between the last time full return current IT and the previous (before 170 ms) full return current IT' is computed based on the following formula 8 to compute this difference as a variation amount ΔIT of the full return current for slope detection. Thereafter, process shifts to step 75 to update the previous full return current IT' stored in the memory into the last time full return current IT (IT'=IT) to shift to step 76 to perform return. Thus, the variation amount ΔIB of the coater current and variation amount ΔIT of the full return current every setting time T1 are computed. In this case, the full return currents IT, IT' ordinarily have the same polarity. For this reason, increment of an absolute value of the full return current IT may be computed as variation amount ΔIT of the full return current.

$$\Delta IT = IT - IT' \quad \text{[Formula 8]}$$

Thus, also in the fourth embodiment, it is possible to obtain operational effects similar to those of the first and the second embodiments. In the fourth embodiment, there is employed a configuration in which when an absolute value of the full return current IT exceeds a predetermined shut-off threshold current value IT0, or when variation amount ΔIT of the full return current exceeds a predetermined shut-off threshold variation amount ΔIT0, it outputs a shut-off signal for shutting off supply of the power supply voltage Vdc to the power supply voltage control device 17. For this reason, variation amount ΔIT of coater current may be used without being limited to the absolute value of the full return current IT to have ability to discriminate whether insulating property of the coater 1 has been deteriorated.

It is to be noted that while explanation has been given in the fourth embodiment by taking, as an example, the case where it is applied to the second embodiment, the fourth embodiment may be applied to the first or third embodiment.

In the first to fourth embodiments, steps 5 to 10, 16 to 23, 47 to 54, 59, 60, 63 and 64 indicate a practical example of the power supply shut-off device; steps 4, 14 and 45 indicate a practical example of coater current computing processor; steps 5, 6, 9, 10, 16 to 19, 22 and 23 indicate a practical example of coater current extraordinary state processor; steps 7 to 10, 20 to 23, 53, 54, 59, 60, 63 and 64 indicate a practical example of a full return current extraordinary state processor; step 46 indicates a practical example of coating object current computing processor; steps 47, 48, 59 and 60 indicate a practical example of a coating object current extraordinary state processor; and steps 55 to 58 indicate a practical example of insulation deterioration alarm processor.

The shut-off threshold current values IB0, IT0, IX0 and ILa0 to ILe0, shut-off threshold variation amounts ΔIB0 and ΔIT0, and alarm threshold current values ILa1 to ILe1, and the like may be set as occasion demands in accordance with the kind of the coater and/or coating condition thereof, and the like without being limited to values indicating as examples in the respective embodiments.

In the second and fourth embodiments, variation amount ΔIB of the coater current and variation amount ΔIT of the full return current are used for shut-off process for shutting off supply of voltage. However, the present invention is not limited to the same, but there may be employed a configuration used for alarm process to generate alarm by using variation amount of coater current, or variation amount of the full return current, for example.

In the third embodiment, there is employed such a configuration adapted to discriminate whether the coater 1 is caused to be close to the coating object A in dependency upon whether the coating object current IX exceeds the shut-off threshold current value IX0. However, the present invention is not limited to the same, but there may be also a configuration adapted to compute variation amount ΔIX of coating object current IX in accordance with a process similar to the slope detection process according to the second embodiment, for example, to discriminate whether the coater 1 is caused to be close to the coating object A in dependency upon whether the variation amount ΔIX exceeds a predetermined shut-off threshold variation amount ΔIX0. Moreover, there may be employed a configuration in which determination process based on the variation amount ΔIB of the coater current according to the second embodiment is combined with the third embodiment.

In the third embodiment, while leakage currents flowing in air passages 4, 7, 12 are respectively independently detected by means of current sensors 33 to 35, there may be employed a configuration adapted to collectively detect, in total, leakage currents flowing in the air passages 4, 7, 12 by a single full air passage current, for example.

In the first to fourth embodiments, explanation has been given by taking, as an example, a direct electrifying type rotary atomizing head type coating apparatus adapted to form rotary atomizing head 5 by metallic material or conductive resin material to directly electrify paint through the rotary atomizing head 5 so that there results a high voltage. However, the present invention is not limited to the same, and may be applied to an indirect electrifying type rotary atomizing head type coating apparatus adapted so that external electrode is provided on the outer peripheral side of the cover of the rotary atomizing head type coating apparatus to indirectly electrify paint sprayed from the rotary atomizing head by the external electrode so that there results a high voltage, for example.

Further, in the first to fourth embodiments, explanation has been given by taking, as an example, the case applied to the rotary atomizing head type coating apparatus adapted to spray paint by using rotary atomizing head 5 (rotary atomizing type electrostatic coating apparatus) as the electrostatic coating apparatus. However, the present invention is not limited to the same, but may be applied to an electrostatic coating apparatus using atomizing system except for rotary atomizing system, for example, air atomizing type electrostatic coating apparatus, liquid pressure atomizing electrostatic coating apparatus, and the like.

DESCRIPTION OF REFERENCE NUMERALS

1: Coater
3: Air motor
5: Rotary atomizing head
14: High voltage generator
15: Current detection resistor
17: Power supply voltage control device
18: AC/DC converter
22: High-voltage control device

23: Voltage setter
24: Coater current detector
25: Input side voltage-dividing circuit
26: Output side voltage-dividing circuit
27: Current sensor (Full return current detector)
31: Leakage current detector
IT: Full return current
IB: Coater current
IX: Coating object current
ILa to ILe: Leakage current
VMi: Input side voltage detection value
VMo: Output side voltage detection value

The invention claimed is:

1. An electrostatic coating apparatus, comprising:

a coater to spray paint onto a coating object;

a high voltage generator which boosts a power supply voltage to generate a high voltage and outputs the high voltage to said coater;

a power supply voltage control device which supplies said power supply voltage to said high voltage generator; and a high-voltage control device which outputs a setting signal for setting said power supply voltage to said power supply voltage control device and controls said high voltage outputted from said high voltage generator, wherein:

a current detection resistor is connected between said high voltage generator and said coater, a coater current detector which detects an amount of current IB supplied to said coater is provided, said coater current detector comprises:

an input side voltage-dividing circuit which divides a voltage applied to an input terminal of said current detection resistor;

an output side voltage-dividing circuit which divides a voltage applied to an output terminal of said current detection resistor; and a coater current computing processor configured to subtract a current Iro flowing in said output side voltage-dividing circuit from a current Irf flowing in said current detection resistor to compute said amount of current IB supplied to said coater, said current Irf flowing in said current detection resistor being determined based on an input side voltage detection value detected by said input side voltage-dividing circuit and an output side voltage detection value detected by said output side voltage-dividing circuit and said current Iro flowing in said output side voltage-dividing circuit being determined based on said output side voltage detection value detected by said output side voltage-dividing circuit, and said high-voltage control device is configured to output a shut-off signal for shutting off supply of said power supply voltage to said power supply voltage control device when said amount of current IB supplied to said coater detected by said coater current detector determines that said coater is within a predetermined distance of said coating object.

2. The electrostatic coating apparatus according to claim 1, further comprising a full return current detector which detects a full return current flowing in a high-voltage application path including said high voltage generator, wherein said high-voltage control device is configured to comprise a full return current extraordinary state processor which outputs a shut-off signal for shutting off supply of said power supply voltage to said power supply voltage control device when an absolute value of a full return current detected by said full return current detector exceeds a predetermined shut-off threshold current value, or when a variation amount of said full return current exceeds a predetermined shut-off threshold variation amount.

3. The electrostatic coating apparatus according to claim 1, wherein said high-voltage control device is configured to comprise a coater current extraordinary state processor which outputs a shut-off signal for shutting off supply of said power supply voltage to said power supply voltage control device when an absolute value of said amount of current IB supplied to said coater detected by said coater current detector exceeds a predetermined shut-off threshold current value, or when a variation amount of said current IB supplied to said coater exceeds a predetermined shut-off threshold variation amount.

4. The electrostatic coating apparatus according to claim 1, further comprising a leakage current detector which detects a leakage current flowing without passing through said coating object, wherein said high-voltage control device comprises:

a coating object current computing processor which subtracts a leakage current detected by said leakage current detector from said amount of current IB supplied to said coater detected by said coater current detector to compute a coating object current flowing between said coater and said coating object, and a coating object current extraordinary state processor which outputs a shut-off signal for shutting off supply of said power supply voltage to said power supply voltage control device when an absolute value of said coating object current by said coating object current computing processor exceeds a predetermined shut-off threshold current value.

5. The electrostatic coating apparatus according to claim 4, wherein said high-voltage control device is configured to further comprise an insulation deterioration alarm processor which serves to notify that insulation deterioration takes place in said coater when said leakage current detected by said leakage current detector indicates that insulation deterioration at an initial stage takes place.

6. The electrostatic coating apparatus according to claim 1, wherein said output side voltage-dividing circuit includes two voltage-dividing resistors connected in series, and said coater current computing processor computes the current Iro flowing in said output side voltage-dividing circuit based on said output side voltage detection value and resistance values of said two voltage-dividing resistors of said output side voltage-dividing circuit.

7. An electrostatic coating apparatus, comprising:

a coater to spray paint onto a coating object;

a high voltage generator configured to boost a power supply voltage to generate a high voltage and output the high voltage to said coater; and power supply voltage control circuitry configured to supply said power supply voltage to said high voltage generator;

processing circuitry configured to output a setting signal that sets said power supply voltage to said power supply voltage control circuitry and control said high voltage outputted from said high voltage generator;

a current detection resistor connected between said high voltage generator and said coater; and a coater current detector configured to detect an amount of current IB supplied to said coater, said coater current detector including an input side voltage-dividing circuit which divides a voltage applied to an input terminal of said current detection resistor; and an output side voltage-dividing circuit which divides a voltage applied to an output terminal of said current detection resistor, wherein the processing circuitry is configured to subtract a current Iro flowing in said output side voltage-dividing circuit from a current Irf flowing in said current detection resistor to compute said amount of current IB supplied to said coater, said current Irf flowing in said current detection resistor being determined based on an input side voltage detection value detected by said input side voltage-dividing circuit and an output side voltage detection value detected by said output side voltage-dividing circuit and said current Iro flowing in said output side voltage-dividing circuit being determined based on said output side voltage detection value detected by said output side voltage-dividing circuit, and output a shut-off signal to shut off supply of said power supply voltage to said power supply voltage control circuitry when said amount of current IB supplied to said coater detected by said coater current detector determines that said coater is within a predetermined distance of said coating object.

* * * * *